US010413462B2

(12) United States Patent
Shimada et al.

(10) Patent No.: US 10,413,462 B2
(45) Date of Patent: Sep. 17, 2019

(54) BED APPARATUS AND BED APPARATUS CONTROL METHOD

(71) Applicant: PARAMOUNT BED CO., LTD., Tokyo (JP)

(72) Inventors: Tatsuya Shimada, Tokyo (JP); Eita Hirai, Tokyo (JP); Yuji Hosokawa, Tokyo (JP); Dan Kageyama, Tokyo (JP); Shinnosuke Kubota, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 106 days.

(21) Appl. No.: 14/784,401

(22) PCT Filed: Mar. 25, 2014

(86) PCT No.: PCT/JP2014/058260
§ 371 (c)(1),
(2) Date: Oct. 14, 2015

(87) PCT Pub. No.: WO2014/174965
PCT Pub. Date: Oct. 30, 2014

(65) Prior Publication Data

US 2016/0051428 A1 Feb. 25, 2016

(30) Foreign Application Priority Data

Apr. 25, 2013 (JP) ..... 2013-092861

(51) Int. Cl.
*A61G 7/015* (2006.01)
*A61G 7/005* (2006.01)
(Continued)

(52) U.S. Cl.
CPC ..... *A61G 7/015* (2013.01); *A61G 7/005* (2013.01); *A61G 7/012* (2013.01); *A61G 7/018* (2013.01)

(58) Field of Classification Search
CPC ..... A61G 7/015; A61G 7/005; A61G 7/012; A61G 7/018
See application file for complete search history.

(56) References Cited

U.S. PATENT DOCUMENTS 3,465,373 A * 9/1969 Wilson ..... A61G 7/002 5/53.1
4,669,136 A * 6/1987 Waters ..... A61G 7/00 177/144
(Continued)

FOREIGN PATENT DOCUMENTS

CN 201775732 U 3/2011
DE 202 07 648 U1 8/2002
(Continued)

OTHER PUBLICATIONS

English Translation of JP 2010-178922 (Year: 2010).*
(Continued)

*Primary Examiner* — Nicholas F Polito
(74) *Attorney, Agent, or Firm* — Renner, Otto, Boisselle & Sklar, LLP

(57) ABSTRACT

In the present invention, in accordance with a tilt and back-raising command (Step S1—Yes), knee-raising operation for raising the knees of the user is performed by actuating a knee bottom placed on a top frame (Step S2). Next, after execution of the knee-raising operation, tilting operation for making the head-side height of the top frame higher than the foot-side height of the top frame by moving up and down the head side and foot side of the top frame relative to the floor (Step S3). By this, the user can take a comfortable position just like sitting in the final position after the user's back has been raised, and it is possible to reduce user's feeling of being pressed on the back and in the belly and prevent user's significant body slippage.

9 Claims, 17 Drawing Sheets

(51) Int. Cl.
*A61G 7/018* (2006.01)
*A61G 7/012* (2006.01)

(56) References Cited

U.S. PATENT DOCUMENTS

| | | | | |
|---|---|---|---|---|
| 4,847,929 | A * | 7/1989 | Pupovic | A61G 7/015 5/604 |
| 5,161,274 | A * | 11/1992 | Hayes | A47C 20/041 5/616 |
| 7,246,389 | B2 * | 7/2007 | Taguchi | A61G 7/001 5/608 |
| 7,926,131 | B2 | 4/2011 | Menkedick | |
| 2002/0144350 | A1 | 10/2002 | Shih | |
| 2005/0166323 | A1 * | 8/2005 | Kawakami | A61G 7/001 5/610 |
| 2005/0172405 | A1 * | 8/2005 | Menkedick | A61B 5/1115 5/618 |
| 2012/0151678 | A1 * | 6/2012 | Richards | A61G 7/00 5/613 |

FOREIGN PATENT DOCUMENTS

| | | | |
|---|---|---|---|
| EP | 2 186 769 | A1 | 5/2010 |
| EP | 2 186 769 | B1 | 1/2015 |
| JP | 03-277316 | A | 12/1991 |
| JP | 2004-298284 | A | 10/2004 |
| JP | 2009-207642 | A | 9/2009 |
| JP | 2009-240583 | A | 10/2009 |
| JP | 2010-178922 | A | 8/2010 |

OTHER PUBLICATIONS

Notification of Reasons for Refusal dated Jan. 19, 2017 for corresponding Japanese Application No. 2016-012780.
International Preliminary Report on Patentability for corresponding International Application No. PCT/JP2014/058260 dated Oct. 27, 2015 (English translation).
International Search Report for corresponding International Application No. PCT/JP2014/058260 dated Apr. 22, 2014.
Extended European Search Report dated Nov. 7, 2016 for corresponding European Application No. 14788377.1.

* cited by examiner

BED APPARATUS AND BED APPARATUS CONTROL METHOD

TECHNICAL FIELD

The present invention relates to a bed apparatus as well as a control method for controlling a bed apparatus.

BACKGROUND ART

There have been known bed apparatus equipped with a lifting mechanism (e.g. Patent Document 1). The lifting mechanism can move up and down a top frame relative to the floor to adjust the height of the top frame.

There have been also known bed apparatus equipped with a mechanical unit that perform back-raising operation and knee-raising operation (e.g., Patent Document 2). In the back-raising operation, the back bottom placed on the top frame is actuated to raise the back of the user on the back bottom and thereby move the user lying (face upward) in bed to their sitting position. In the knee-raising operation, the knee bottom placed on the top frame is actuated to raise the user's knees.

The bed apparatus of this kind is used at home by the user who is physically handicapped, for example. The user can set themself into their preferable position by actuating the bed apparatus to perform back-raising and knee-raising operations.

Alternatively, the caregiver causes the bed apparatus to perform back-raising and knee-raising operations, to thereby make it easy to care the user. In this way, the bed apparatus not only helps the user who uses the bed at home to move, but also helps the caregiver who nurses the user to work.

PRIOR ART DOCUMENTS

Patent Documents

Patent Document 1:
Japanese Patent Application Laid-open 2009-207642
Patent Document 2:
Japanese Patent Application Laid-open 2009-240583

SUMMARY OF THE INVENTION

Problems to be Solved by the Invention

For example, to take a meal or for other purposes, the user can move from a lying position into a sitting position by causing the bed apparatus to perform a back-raising operation. However, in the back-raising operation, since the user's knees are unbent at the final position after back-raising, some users may feel uncomfortable.

On the other hand, in Patent Document 2, the back-raising operation is performed in linkage with the knee-raising operation in order to reduce user's feeling of being pressed on the back or in the belly or in order to prevent user's significant body slippage. However, this cannot be said to be a good enough measure for some users.

In view of the above circumstances, it is therefore an object of the present invention to provide a bed apparatus, as well as a bed apparatus control method, that can make the user take a comfortable posture close to sitting position in the final position after back-raising, and that can reduce user's feeling of being pressed on the back or in the belly and prevent user's significant body slippage.

Means for Solving the Problems

A bed apparatus according to the first aspect of the present invention comprises:

a bottom driver capable of performing knee-raising operation for raising the knees of a user by actuating a knee bottom placed on a top frame;

a head-side driver and foot-side driver that can move up and down the head side and foot side of the top frame relative to the floor, respectively;

a bottom controller that controls the bottom driver so as to perform the knee-raising operation in accordance with a tilt and back-raising command; and, a height controller for controlling the head-side driver and the foot-side driver so as to perform tilting operation for making the head-side height of the top frame higher than the foot-side height of the top frame, after execution of the knee-raising operation.

According to the second aspect of the invention, the bed apparatus having the first aspect of the invention is further characterized in that the bottom controller controls the bottom driver so as to perform back-raising operation for raising the back of the user and the knee-raising operation by actuating a back bottom placed on the top frame, before execution of the tilting operation.

According to the third aspect of the invention, the bed apparatus having the first aspect of the invention is further characterized in that the bottom controller controls the bottom driver so as to perform back-raising operation for raising the back of the user by actuating a back bottom placed on the top frame, after execution of the tilting operation.

According to the fourth aspect of the invention, the bed apparatus having the first aspect of the invention is further characterized in that the bottom controller controls the bottom driver so as to perform a first back-raising operation for raising the back of the user and the knee-raising operation by actuating a back bottom placed on the top frame, before execution of the tilting operation, and controls the bottom driver so as to perform a second back-raising operation for further raising the back of the user by actuating the back bottom, after execution of the tilting operation.

According to the fifth aspect of the invention, the bed apparatus having any one of the first to fourth aspects of the invention is further characterized in that the bottom controller controls the bottom driver so as to perform knee-lowering operation for lowering the knees of the user by actuating the knee bottom, after execution of the tilting operation, and the angle of the knee bottom formed relative to the ground by the knee-lowering operation performed after the tilting operation is equal to or greater than 0°.

According to the sixth aspect of the invention, the bed apparatus having t having any one of the first to fourth aspects of the invention is further characterized in that the bottom controller controls the bottom driver so as to perform the knee-raising operation after execution of the tilting operation.

A bed apparatus control method of the present invention comprises:

a bottom control step of performing knee-raising operation for raising the knees of a user by actuating a knee bottom placed on a top frame, in accordance with a tilt and back-raising command; and, a height control step of performing tilting operation for making the head-side height of the top frame higher than the foot-side height of the top frame by moving up and down the head side and the foot side of the top frame relative to the floor, after execution of the knee-raising operation.

Effect of the Invention

According to the present invention, in accordance with a tilt and back-raising command, the back-raising operation and knee-raising operation are performed. After execution of the back-raising operation and knee-raising operation, the aforementioned tilting operation is performed. In the back-raising operation, in the final position in which the user' back has been raised, since the user's knees are unbent, some users may feel uneasy. However, in the case where the tilting operation is performed after the back-raising operation and the knee-raising operation, the knee bottom serves as the seat of a chair while the back bottom serves as the hip rest of the chair, so that the user will feel a sensation just like experiencing transition from the supine position in bed to the sitting position in a chair. In the above way, according to the present invention, since the tilting operation is performed after execution of the back-raising operation and the knee-raising operation, the user can take a comfortable position just like sitting in the final position after the user's back has been raised. Further, it is possible to reduce user's feeling of being pressed on the back and in the belly and prevent user's significant body slippage.

According to the present invention, since the knee-raising operation is performed before the tilting operation, it is possible to prevent the user in the tilted state from falling.

MODE FOR CARRYING OUT THE INVENTION

Next, the embodiments of the present invention will be described with reference to the accompanying drawings.

Figure 1:
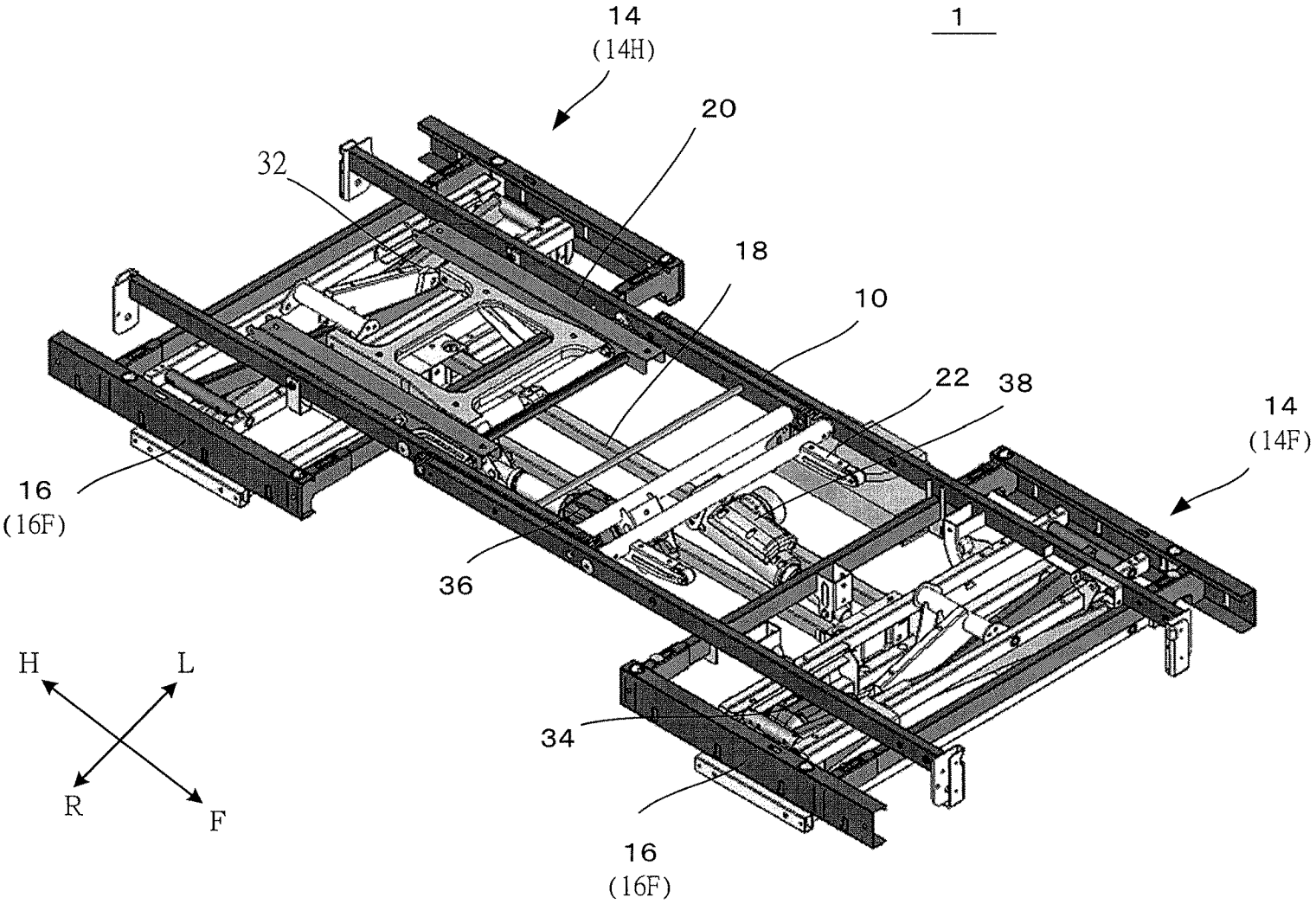
FIG. 1 An overall perspective view of a frame on which bottoms are mounted in a bed apparatus 1 according to the present invention.
Figure 2:
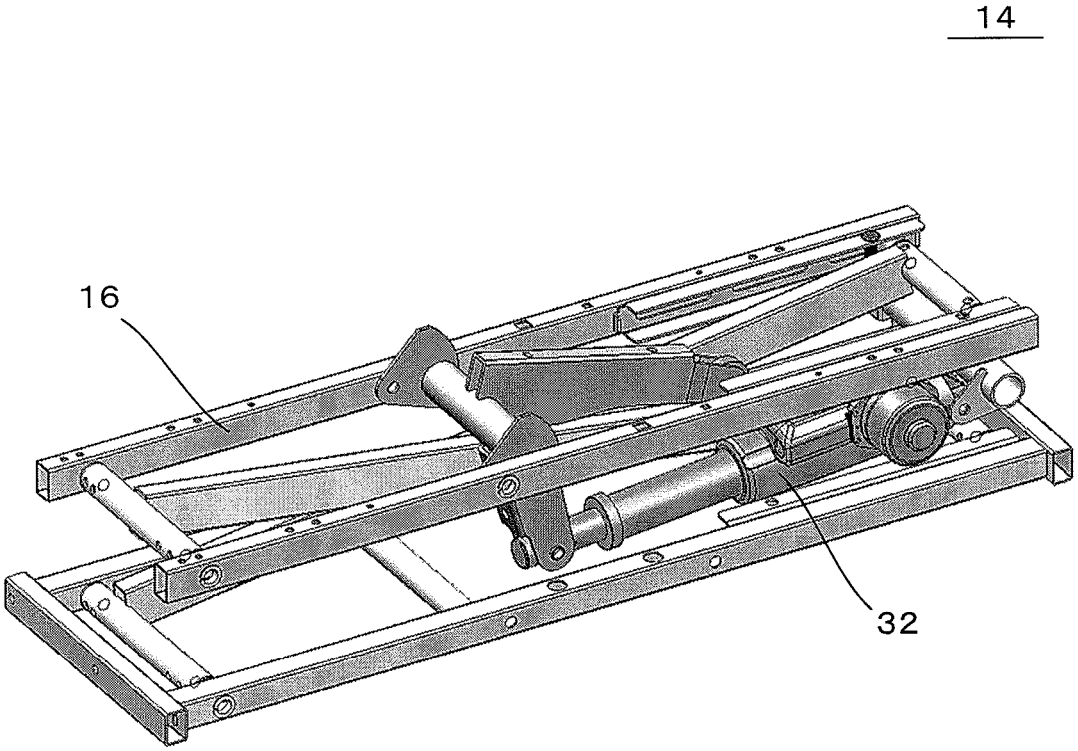
FIG. 2 A perspective view of a lift unit 14 (head-side lift unit 14H) in FIG. 1.

FIG. 1 is an overall perspective view of a frame on which bottoms are mounted in a bed apparatus 1 according to the present invention. In FIG. 1, in the bed apparatus, the head side to which the user's head is oriented when the user is lying is indicated by "H" and the foot side to which the user's feet are oriented when the user is lying is indicated by "F". FIG. 2 is a perspective view of a lift unit 14 (head-side lift unit 14H) in FIG. 1.

As shown in FIG. 1, the bed apparatus 1 according to the present invention is essentially comprising: a top frame 10 having an approximate ladder structure with its length oriented along the direction from the head side end to the foot side end and its short side oriented in the width direction, a bottom placed on the top frame 10; and a head-side lift unit 14H and a foot-side lift unit 14F that are arranged on the head and foot sides under the top frame 10, respectively, to support the top frame 10 so as to be raised and lowered relative to the floor.

Approximately rectangular support frames 16H and 16F, longer in the width direction of the bed apparatus, are fixed at the head side and foot side to the underside of the top frame, in order to set the top frame on top of the lift units 14H and 14F.

The lower ends of the lift units 14H and 14F are detachably connected to each other by a connecting frame 18. The connecting frame 18 has a paired pipe frame structure, which is arranged with its length oriented to the head and foot sides.

The lift units 14H and 14F include actuators 32 and 34, respectively, so that the drive force of each actuator 32 and 34 is controlled separately. Drive control of each actuator 32 and 34 makes it possible to perform a tilting operation of producing height difference between the head side and foot side of the top frame 10.

The top frame 10 is also equipped with a back-raising linkage 20 on the head side and a knee-raising linkage 22 around the center. Further, actuators 36 and 38 for driving these linkages are also provided. A back-raising operation can be achieved by actuating the back-raising linkage 20 with the bottom mounted on the top frame 10, whereas a knee-raising operation can be achieved by actuating the knee-raising linkage 22.

Figure 3:
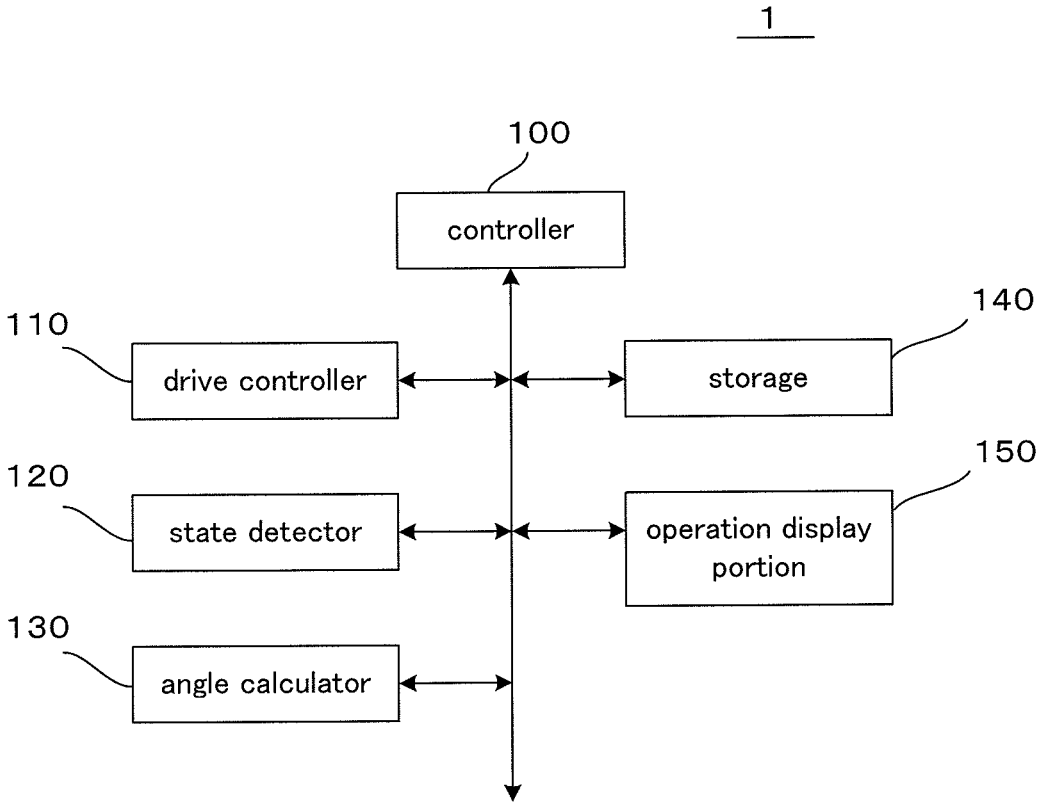
FIG. 3 A block diagram showing a configuration of a control system of the bed apparatus 1 according to the present invention.

FIG. 3 is a block diagram showing a configuration of a control system of the bed apparatus 1 of the present invention.

The bed apparatus 1 according to the present invention further includes a controller 100, a drive controller 110, a state detector 120, an angle actuator 130, a storage 140 and an operation display portion 150. The controller 100 controls the drive controller 110, the state detector 120, the angle calculator 130, the storage 140 and the operation display portion 150. The controller 100 is formed of, for example, a CPU (Central Processing Unit) and the like.

Figure 4:
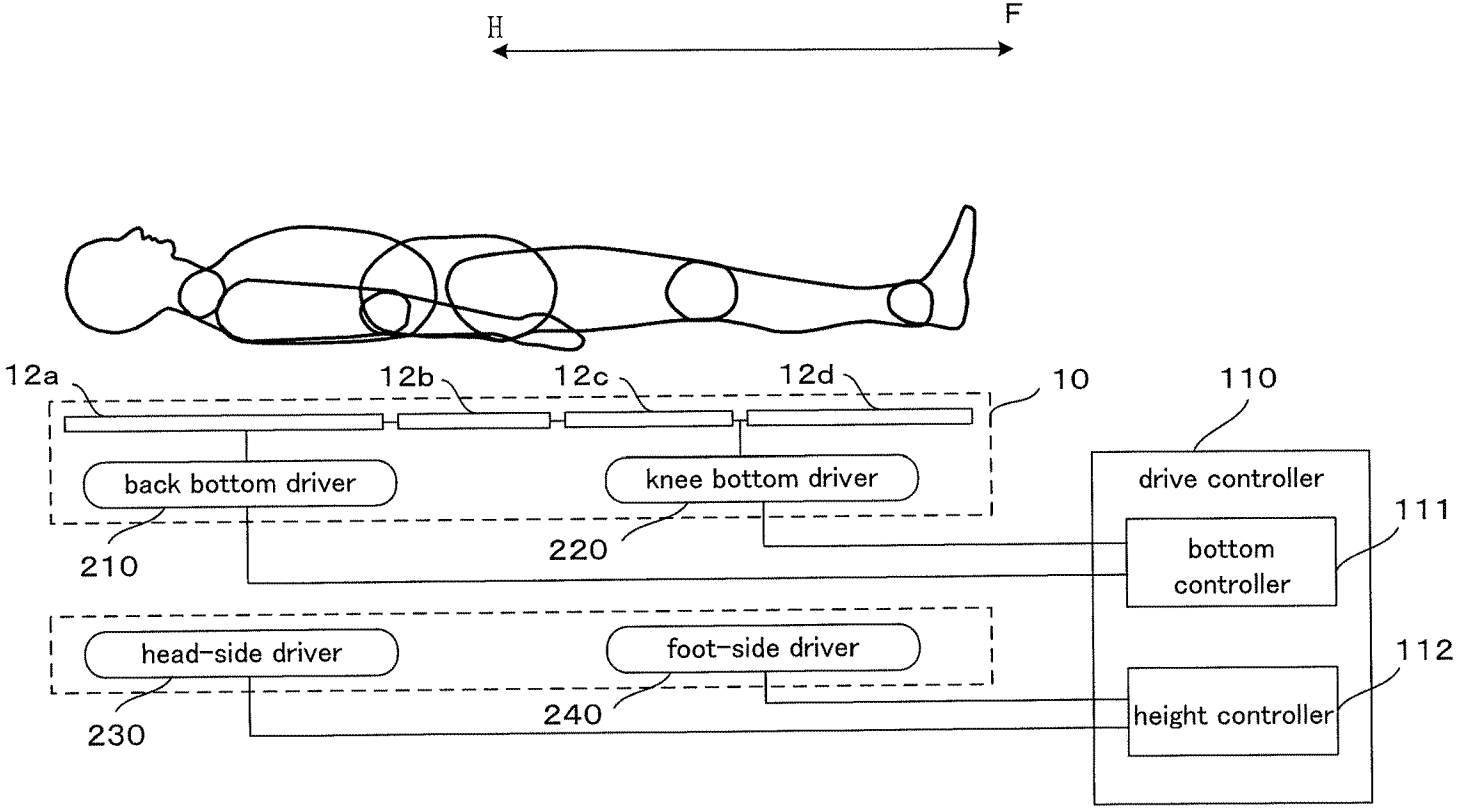
FIG. 4 A block diagram showing control targets to be controlled by a drive controller 110 in FIG. 3.
Figure 5:
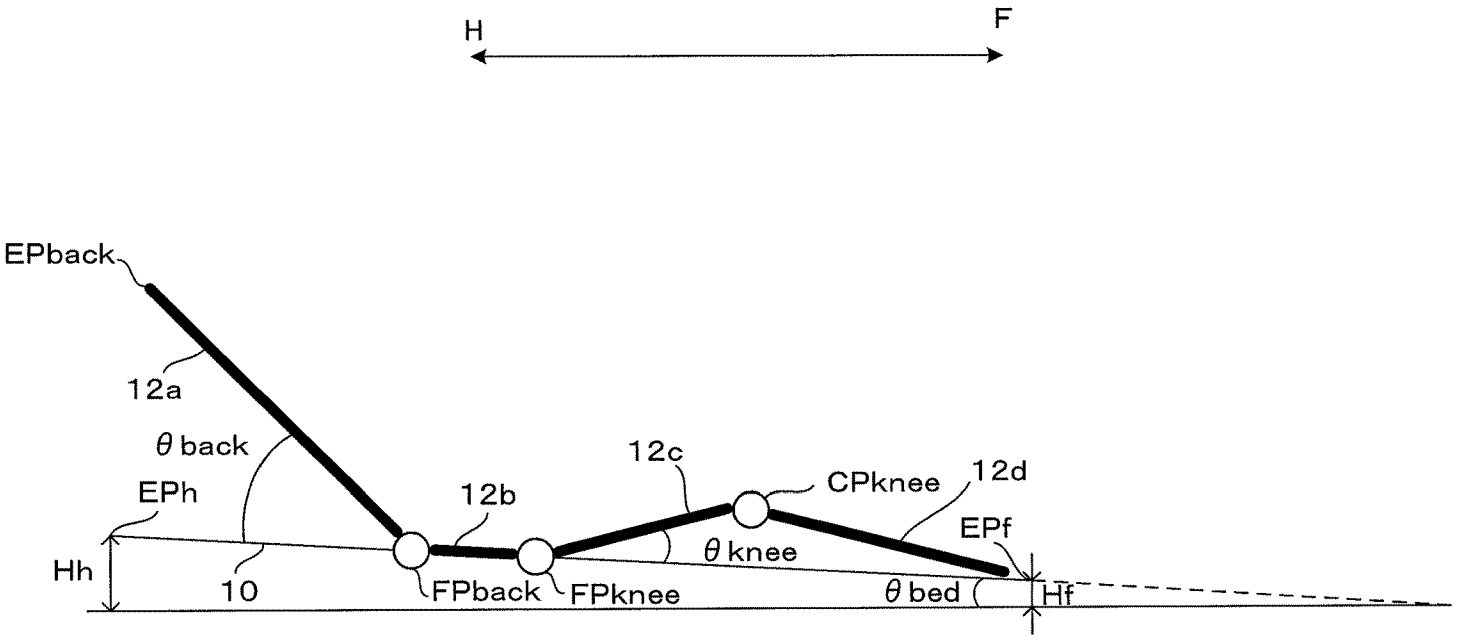
FIG. 5 A diagram showing parameters used in the bed apparatus 1 according to the present invention.

FIG. 4 is a block diagram showing control targets to be controlled by the drive controller 110 of FIG. 3. FIG. 5 is a diagram showing parameters used in the bed apparatus 1 according to the present invention.

The drive controller 110 includes a bottom controller 111 and a height controller 112. The bottom controller 111 controls a back bottom driver 210 and a knee bottom driver 220. The height controller 112 controls a head-side driver 230 and a foot-side driver 240. The back bottom driver 210 corresponds to the actuator 36 for driving the back-raising linkage 20 mentioned above. The knee bottom driver 220 corresponds to the actuator 38 for driving the knee-raising linkage 22 mentioned above. The head-side driver 230 corresponds to the actuator 32 for the aforementioned head-side lift unit 14H. The foot-side driver 240 corresponds to the actuator 34 for the aforementioned foot-side lift unit 14F.

The bottoms placed on the top frame 10 include a back bottom 12*a*, a hip bottom 12*b*, a knee bottom 12*c* and a foot bottom 12*d*.

The top of the back bottom 12*a* is the surface in contact with the back of the user who is lying supine. One end of the back bottom 12*a* is the side to which the user's head is oriented. The end of the back bottom 12*a* will be called hereinbelow the head-side end EPback.

The top of the hip bottom 12*b* is the surface in contact with the hips of the user who is lying supine. The other end of the back bottom 12*a* is coupled with one end of the hip bottom 12*b* by means of a joint FPback. The back bottom 12*a* is supported by the back-raising linkage 20 so as to be rotated up and down on the joint FPback as a pivot relative to the top frame 10.

The top of the knee bottom 12*c* is the surface in contact with the thighs of the user who is lying supine. The other end of the hip bottom 12*b* is coupled with one end of the knee bottom 12*c* by means of a joint FPknee. The knee bottom 12*c* is supported by the knee-raising linkage 22 so as to be rotated up and down on the joint FPknee as a pivot relative to the top frame 10.

The top of the foot bottom 12*d* is the surface in contact with the calves of the user who is lying supine. The other end of the knee bottom 12*c* is coupled with one end of the foot bottom 12*d* by means of a joint CPknee. The foot bottom 12*d* is rotatably coupled with the knee bottom 12*c*.

The back-raising linkage 20 is attached to the undersurface of the back bottom 12*a*. The back bottom driver 210 can perform back-raising operation and back-lowering operation. In the back-raising operation, with the bottom placed on the top frame 10, the back-raising linkage 20 (back bottom 12*a*) is actuated to thereby raise the user's back being in contact with the back bottom 12*a* so that the user is moved from the lying position (lying supine) to the sitting position. For example, when taking a meal, the user can cause the bed apparatus 1 to perform a back-raising operation to move themself from the lying position to the sitting position. In the back-lowering operation, the back-raising linkage 20 (back bottom 12*a*) is actuated to thereby lower the user's back being in contact with the back bottom 12*a* so that the user is moved from the sitting position to the laying position (lying supine).

The knee-raising linkage 22 is attached to the undersurface of the knee bottom 12*c*. The knee bottom driver 220 can perform knee-raising operation and knee-lowering operation. In the knee-raising operation, with the bottom placed on the top frame 10, the knee-raising linkage 22 (knee bottom 12*c*) is actuated to thereby raise the user's knees being in contact with the knee bottom 12*c* so that the user's legs are moved from the unbent position to a bent position. In the knee-lowering operation, the knee-raising linkage 22 (knee bottom 12*c*) is actuated to thereby lower the user's knees being in contact with the knee bottom 12*c* so that the user's legs are moved from the bent position to the unbent position.

The head-side driver 230 and foot-side driver 240 can move up and down the head-side end EPh of the top frame 10 and the foot-side end EPf of the top frame 10, relative to the floor, respectively. The head-side driver 230 and foot-side driver 240 adjust the height of the top frame 10 (the bed height for the user) by moving up and down the top frame 10 relative to the floor.

In the present invention, the user or the caregiver of the user can make the bed apparatus 1 perform an aftermentioned tilt and back-raising process by giving a tilt and back-raising command via the operation display portion 150. Also, after the tilt and back-raising process, the user or the caregiver can make the bed apparatus 1 perform an aftermentioned tilt-release and back-lowering process by giving a tilt-release and back lowering command via the operation display portion 150.

Figure 6:
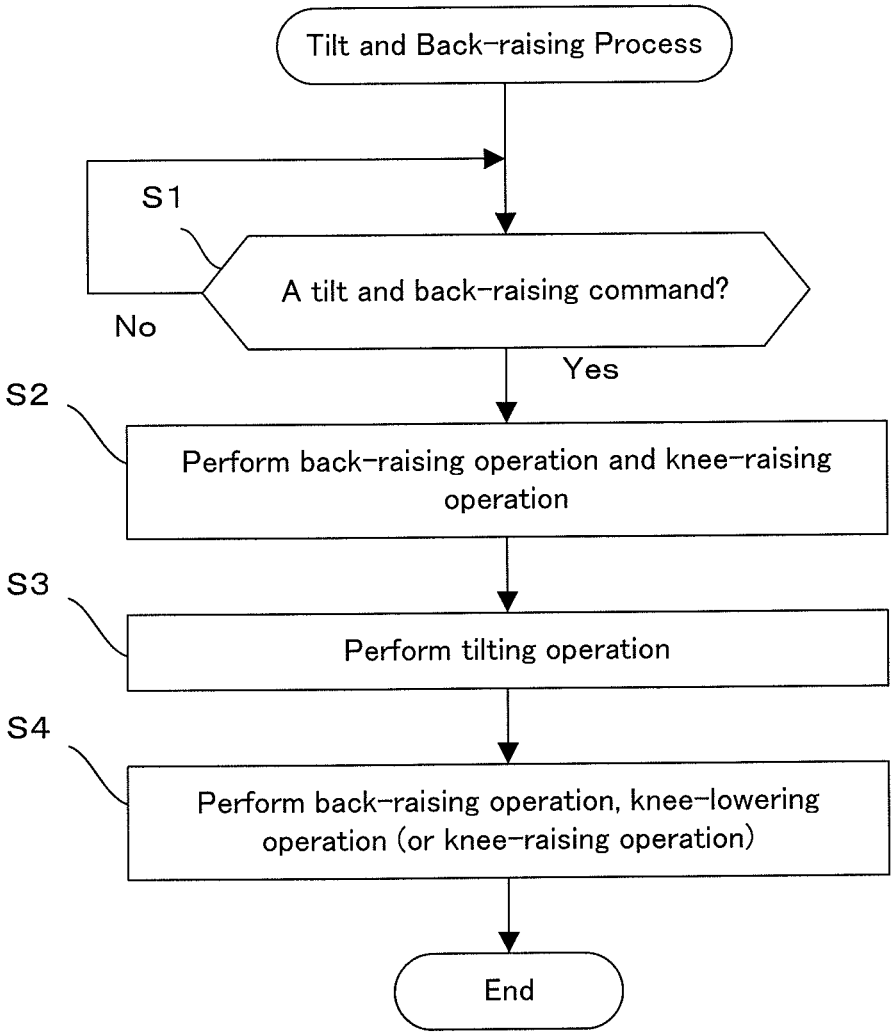
FIG. 6 A flow chart for illustrating a tilt and back-raising process performed by the drive controller 110 of the bed apparatus 1 according to the present invention.

FIG. 6 is a flow chart for illustrating a tilt and back-raising process performed by the drive controller 110 of the bed apparatus 1 according to the present invention.

Now, a tilt and back-raising process is started in accordance with a tilt and back-raising command (Step S1—Yes). In this case the bottom controller 111 of the drive controller 110 controls the back bottom driver 210 so as to perform a back-raising operation (the first back-raising operation) for raising the user's back by actuating the back bottom 12*a* and also controls the knee bottom driver 220 so as to perform a knee-raising operation for raising user's knees by actuating the knee bottom 12*c* (Step S2).

At Step S2, when the back-raising operation has been performed, the back bottom 12*a* is positioned at an angle ° back with the top frame 10. Further, when the knee-raising operation has been performed, the knee bottom 12*c* is positioned at an angle θknee with the top frame 10.

After Step S2, or specifically, after the back-raising operation and knee-raising operation, the height controller 112 of the drive controller 110 controls the head-side driver 230 and foot-side driver 240 so as to perform a tilting operation for setting the head-side end of the top frame 10 higher than the foot-side end of the top frame 10 (Step S3).

At Step S3, when the tilting operation has been performed, the height Hh of the head-side end EPh of the top frame 10 from the floor is higher than the height Hf of the foot-side end EPf of the top frame 10 from the floor, so that the top frame 10 is positioned at an angle θbed with the floor.

After Step S3, or specifically, after the tilting operation, the bottom controller 111 of the drive controller 110 controls the back bottom driver 210 so as to perform a back-raising operation (the second back-raising operation) for further raising the user's back by actuating the back bottom 12*a* and also controls the knee bottom driver 220 so as to perform a knee-lowering operation for lowering user's knees by actuating the knee bottom 12*c* or perform a knee-raising operation for further raising user's knees by actuating the knee bottom 12*c* (when the knee-raising operation before the tilting operation is called the first knee-raising operation, the knee-raising operation after the tilting operation is called the second knee-raising operation) (Step S4).

At this stage, when the specification of the bed apparatus 1 is such that the angle θknee of the knee bottom 12*c* has been made greater by the knee-raising operation (Step S2) performed before the tilting operation (Step S3), than the previously determined, preset knee bottom angle at tilting, at Step S4, the bottom controller 111 of the drive controller 110 controls the knee bottom driver 220 so as to perform a knee-lowering operation by actuating the knee bottom 12*c* until the angle θknee of the knee bottom 12*c* lowers to the preset knee bottom angle at tilting. The angle θknee of the knee bottom 12*c* set by the knee-lowering operation after the tilting operation, or the preset knee bottom angle at tilting, is equal to or greater than 0° relative to the ground, and smaller than the maximum angle of the knee bottom 12*c* set by the knee-raising operation before the tilting operation. Thereby, in the bed apparatus 1, in the tilt and back-raising process, the knee bottom 12*c* works as a seat of a chair or bearing surface so as to prevent user' slippage from the top frame 10.

On the other hand, when the specification of the bed apparatus 1 is such that the angle θknee of the knee bottom 12*c* has not been made to reach the aforementioned preset knee bottom angle at tilting, by the first knee-raising operation (Step S2) performed before the tilting operation (Step S3), at Step S4, the bottom controller 111 of the drive controller 110 controls the knee bottom driver 220 so as to perform the second knee-raising operation by actuating the knee bottom 12*c* until the angle θknee of the knee bottom 12*c* reaches the preset knee bottom angle at tilting.

When the tilt and back-raising process has been done, the head-side driver 230 and foot-side driver 240 support the top frame 10 relative to the floor, to keep the tilt state that the height of the head-side end is higher than the height of the foot-side end. Further, the bottom drivers (back bottom driver 210 and knee bottom driver 220) support the user's back and knees by use of the back bottom 12*a* and the knee bottom 12*c* placed on the top frame 10 as the seat of a chair and the hip rest of the chair, respectively, to keep the back-raised state for raising the user's back by the back bottom 12*a* and keep the knee-raised state for raising the user's knees by the knee bottom 12*c*, relative to the top frame 10 kept in the tilt state.

Figure 7:
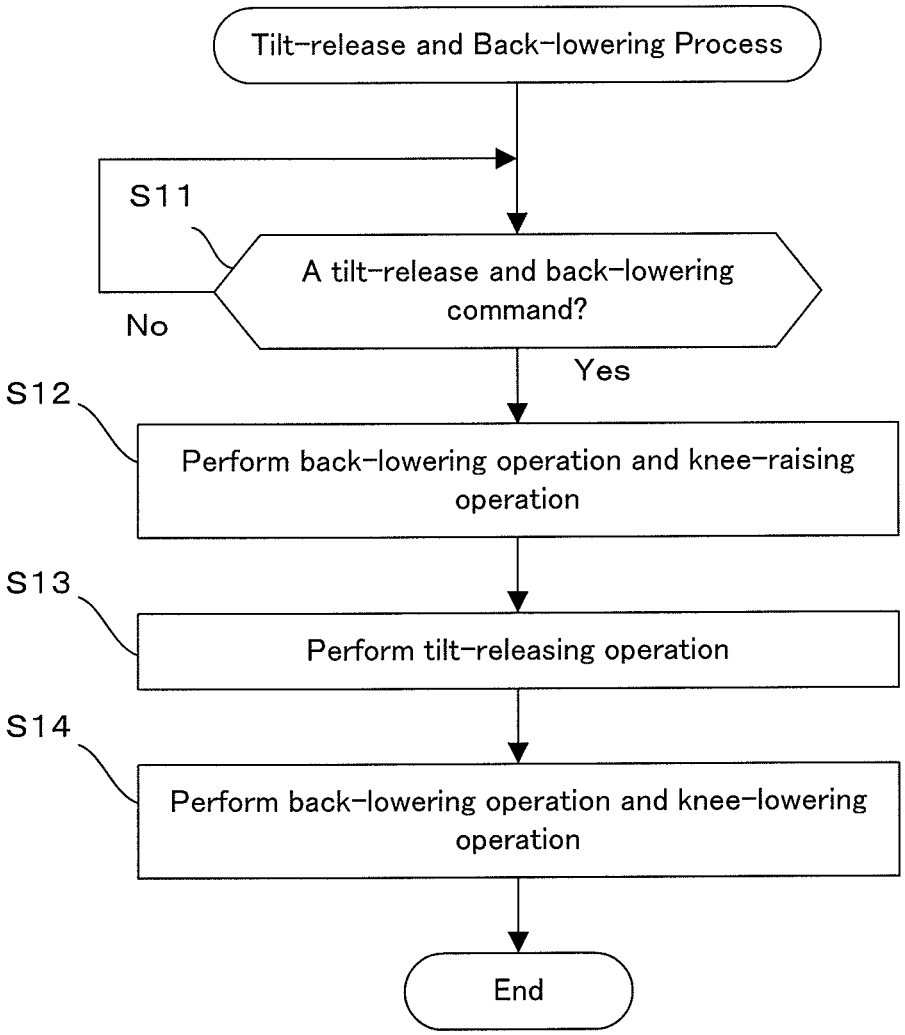
FIG. 7 A flow chart for illustrating a tilt-release and back-lowering process performed by the drive controller 110 of the bed apparatus 1 according to the present invention.

FIG. 7 is a flow chart for illustrating a tilt-release and back-lowering process performed by the drive controller 110 of the bed apparatus 1 according to the present invention.

From the state after the tilt and back-raising process has been performed, a tilt-release and back-lowering process is started in accordance with a tilt-release and back-lowering command (Step S11—Yes). In this case the bottom controller 111 of the drive controller 110 controls the back bottom driver 210 so as to perform a back-lowering operation by actuating the back bottom 12*a*. In order to prevent the user in the tilted state from falling, the bottom controller 111 also controls the knee bottom driver 220 so as to perform a knee-raising operation for further raising user's knees by actuating the knee bottom 12*c* (Step S12).

After Step S12, or specifically, after the back-lowering operation and knee-raising operation, the height controller 112 of the drive controller 110 controls the head-side driver 230 and foot-side driver 240 so as to perform a tilt-releasing operation for setting the head-side end of the top frame 10 equal in height to the foot-side end of the top frame 10 (Step S13).

After Step S13, or specifically, after the tilt-releasing operation, the bottom controller 111 of the drive controller 110 controls the back bottom driver 210 so as to perform a back-lowering operation by actuating the back bottom 12*a* and also controls the knee bottom driver 220 so as to perform a knee-lowering operation by actuating the knee bottom 12*c* (Step S14).

At this stage, when the specification of the bed apparatus 1 is such that the back bottom 12*a* has not been set into the horizontal state relative to the top frame 10 by the first back-lowering operation, that is, the back-lowering operation performed before the tilt-releasing operation (Step S14), the bottom controller 111 of the drive controller 110 controls the back bottom driver 210 so as to perform the second back-lowering operation for further lowering the user's back by actuating the back bottom 12*a* until the back bottom 12*a* is set horizontal relative to the top frame 10.

As described above, the bed apparatus 1 according to the present invention realizes the following effect when the tilt and back-raising process is performed in accordance with a tilt and back-raising command.

In the bed apparatus 1 according to the present invention, the bottom controller 111 controls the bottom drivers (back bottom driver 210 and knee bottom driver 220) so as to perform the above-described back-raising operation and knee-raising operation while the height controller 112 controls the head-side driver 230 and foot-side driver 240 so as to perform the above-described tilting operation after execution of the back-raising operation and knee-raising operation in accordance with a tilt and back-raising command. In the back-raising operation, in the final position in which the user' back has been raised, since the user's knees are unbent, some users may feel uneasy. However, in the case where the tilting operation is performed after the back-raising operation and the knee-raising operation by the tilt and back-raising process, the knee bottom 12*c* serves as the seat of a chair while the back bottom 12*a* serves as the hip rest of the chair, so that the user will feel a sensation just like experiencing transition from the supine position in bed to the sitting position in a chair. In the above way, according to the bed apparatus 1 of the present invention, since the tilting operation is performed after execution of the back-raising operation and the knee-raising operation, the user can take a comfortable position just like sitting in the final position after the user's back has been raised. Further, it is possible to reduce user's feeling of being pressed on the back and in the belly and prevent user's significant body slippage.

Further, according to the bed apparatus 1 of the present invention, as another effect of the tilt and back-raising process, it is possible to prevent the user in the tilted state from falling because the knee-raising operation is performed before the tilting operation.

In the bed apparatus 1 according to the present invention, when the tilt-release and back-lowering process is performed in accordance with a tilt-release and back-lowering command after the tilt and back-raising process has been done, the following effects can be obtained.

In the bed apparatus 1 according to the present invention, the bottom controller 111 controls the bottom drivers (back bottom driver 210 and knee bottom driver 220) so as to perform the above-described back-lowering operation and knee-raising operation while the height controller 112 controls the head-side driver 230 and foot-side driver 240 so as to perform the above-described tilt-releasing operation after execution of the back-lowering operation and knee-raising operation. When the tilt-releasing operation is performed after execution of the back-lowering operation and knee-raising operation by the tilt-release and back-lowering process, the user feels a sensation just like experiencing transition from the sitting position in a chair to the supine position with knees raised in bed. In this way, according to the bed apparatus 1 of the present invention, the tilt-releasing operation is performed after execution of the back-lowering operation and knee-raising operation, further the back-lowering operation and the knee-lowering operation are performed, whereby it is possible to transition the user's position from sitting on a chair to lying in bed.

Further, according to the bed apparatus 1 of the present invention, as another effect of the tilt-release and back-lowering process, it is possible to prevent the user in the tilted state from falling because the knee-lowering operation is performed after the tilt-releasing operation has been done.

As the order of the back-raising operation and the knee-raising operation at Step S2 in the tilt and back raising process, as long as this step is performed before the tilting operation (Step S3), the back-raising operation may be performed after the knee-raising operation (see the example described below), the knee-raising operation may be performed after the back-raising operation, or the back-raising operation and the knee-raising operation may be performed at the same time, as in Patent Document 2.

Further, at Step S2 of the tilt and back-raising process, as long as the knee-raising operation is performed before the tilting operation (Step S3), it may be performed alone without performing the back-raising operation. Also in this case, the bed apparatus 1 of the present invention can achieve the above effect of the tilt and back-raising process.

As the order of the back-lowering operation and the knee-lowering operation at Step S14 in the tilt-release and back lowering process, as long as this step is performed after the tilt-releasing operation (Step S13), the back-lowering operation may be performed after the knee-lowering operation, the knee-raising operation may be performed after the back-raising operation (see the example described below), or the back-lowering operation and the knee-lowering operation may be performed at the same time, as in Patent Document 2.

Further, at Step S14 of the tilt-release and back-raising process, as long as the knee-lowering operation is performed after the tilt-releasing operation (Step S13), it may be performed alone. Also in this case, the bed apparatus 1 of the present invention can achieve the above effect of the tilt-release and back-lowering process.

EXAMPLE

Figure 8:
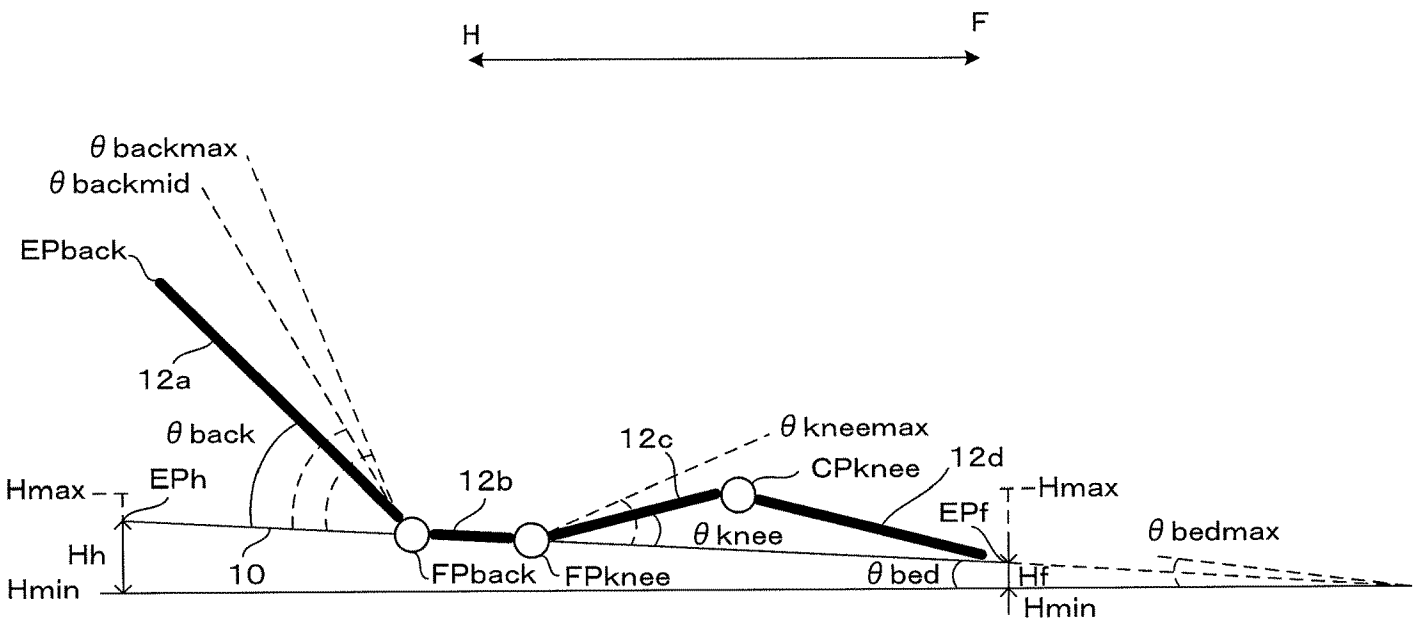
FIG. 8 A diagram showing parameters used in a 4-drive control bed apparatus as the bed apparatus 1 according to the present invention (example).

Next, as a specific example of the bed apparatus 1 according to the present invention, a 4-drive control bed apparatus will be described. FIG. 8 is a diagram showing parameters used in the 4-drive control bed apparatus.

Figure 9:
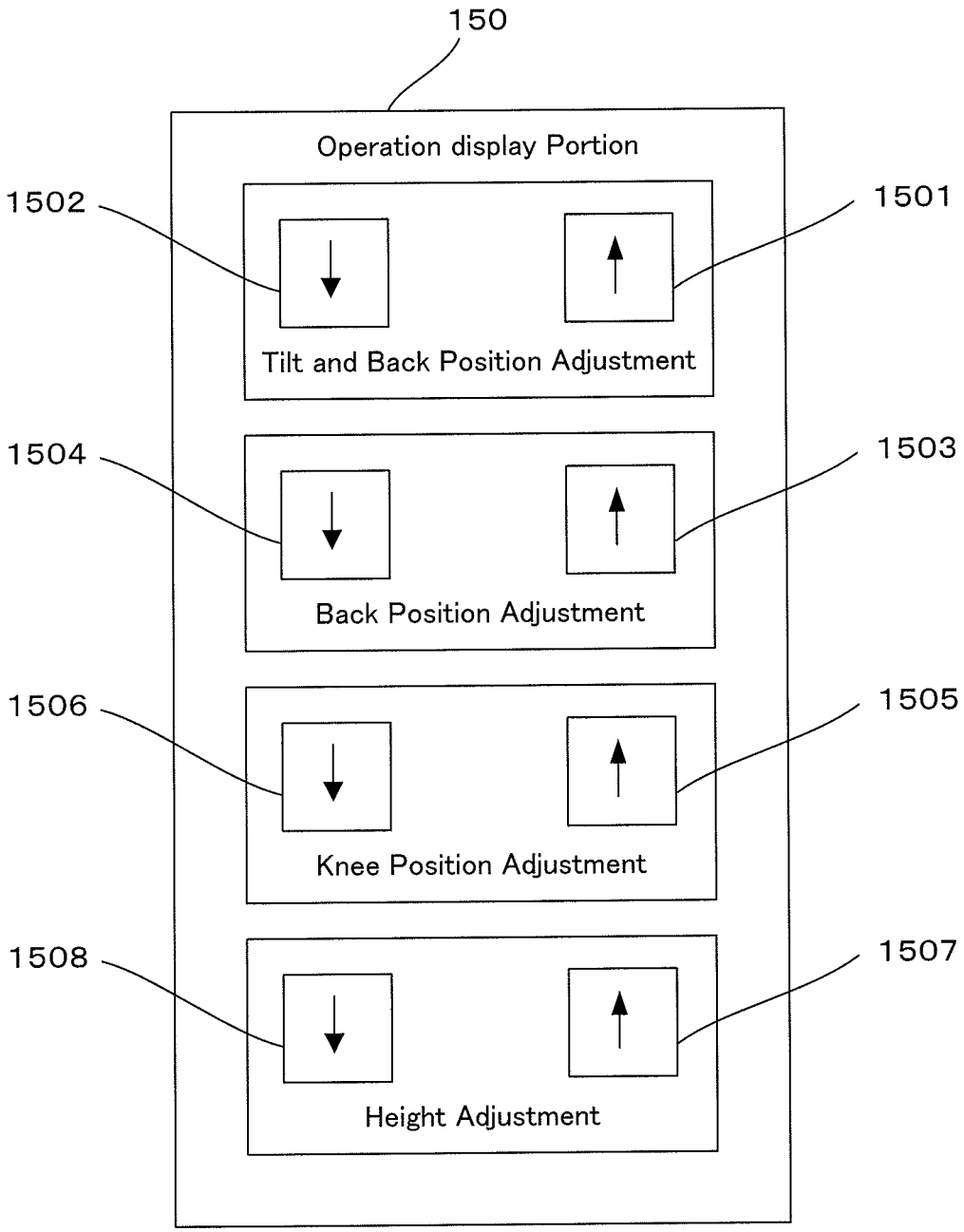
FIG. 9 A block diagram showing a configuration of an operation display portion 150 of a 4-drive control bed apparatus (example).

FIG. 9 is a block diagram showing a configuration of an operation display portion 150 of a 4-drive control bed apparatus. The operation display portion 150 includes a tilt and back position adjustment raising command button 1501, a tilt and back position adjustment lowering command button 1502, a back position adjustment raising command button 1503, a back position adjustment lowering command button 1504, a knee position adjustment raising command button 1505, a knee position adjustment lowering command button 1506, a height adjustment raising command button 1507 and a height adjustment lowering command button 1508. The above-described tilt and back-raising command corresponds to user or caregiver's continuous pressing of the tilt and back position adjustment raising command button 1501.

Figure 10:
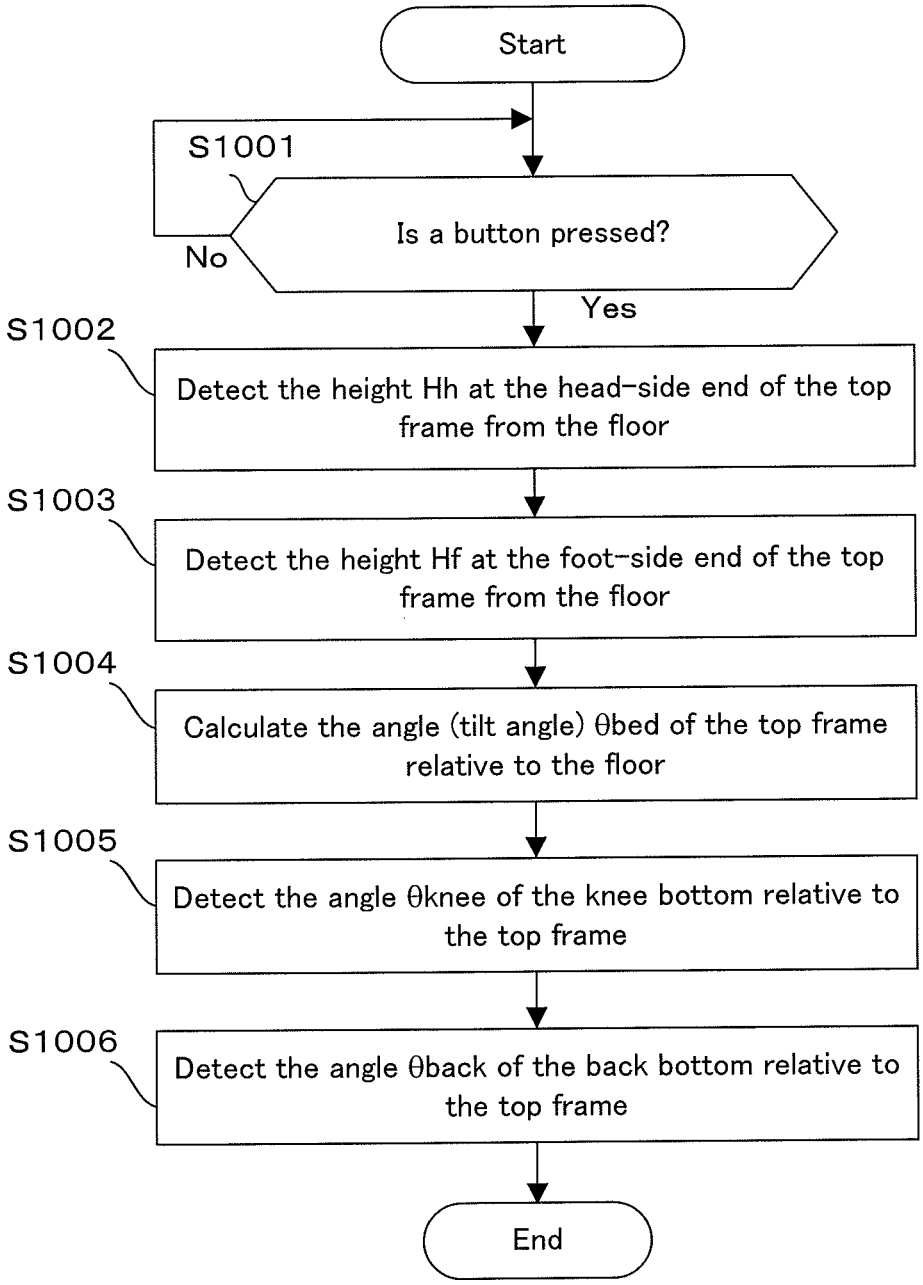
FIG. 10 A flow chart for illustrating the operation of a state detector 120 and an angle calculator 130 in the 4-drive control bed apparatus (example).
Figure 11:
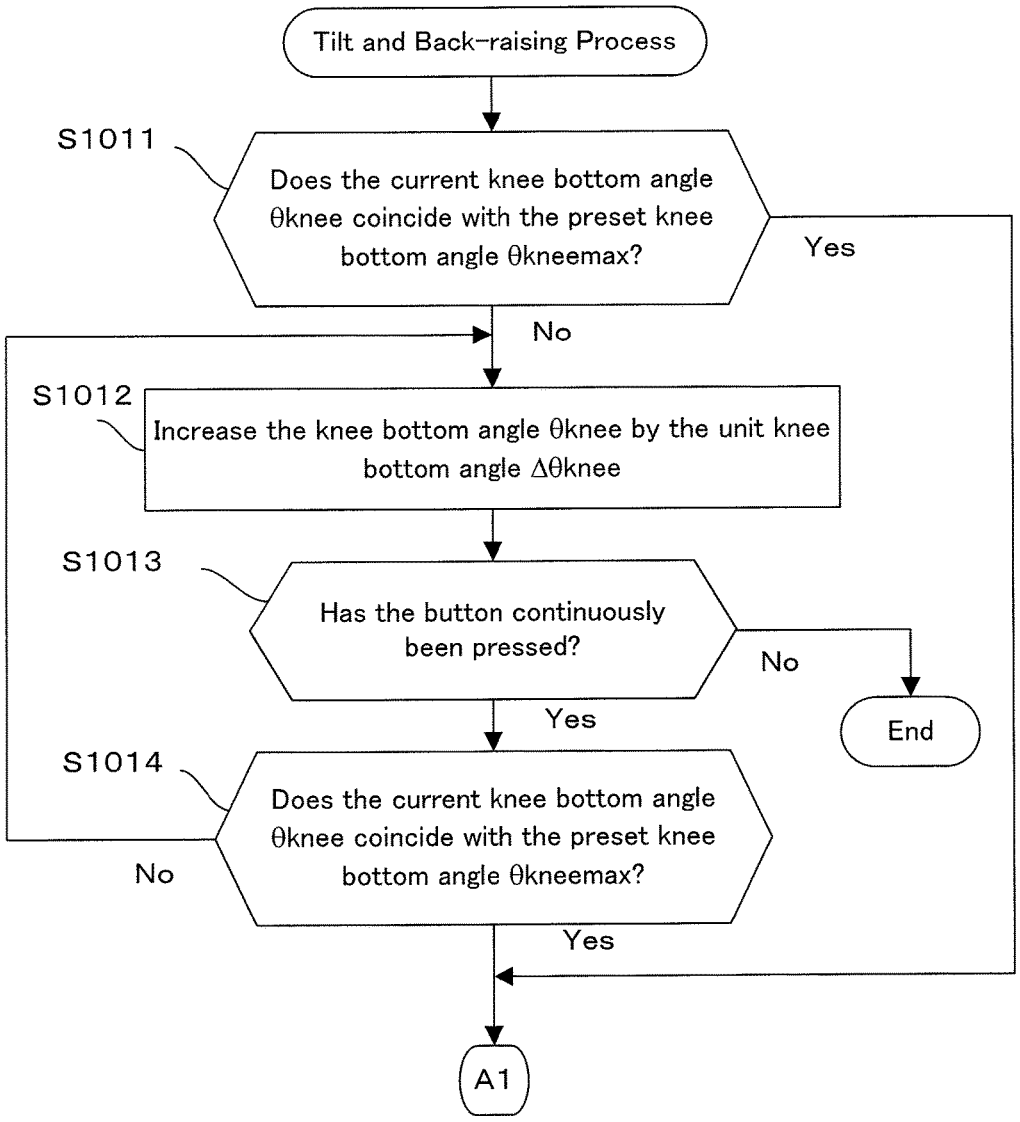
FIG. 11 A flow chart for illustrating a tilt and back-raising process performed by the drive controller 110 of the 4-drive control bed apparatus (example).
Figure 12:
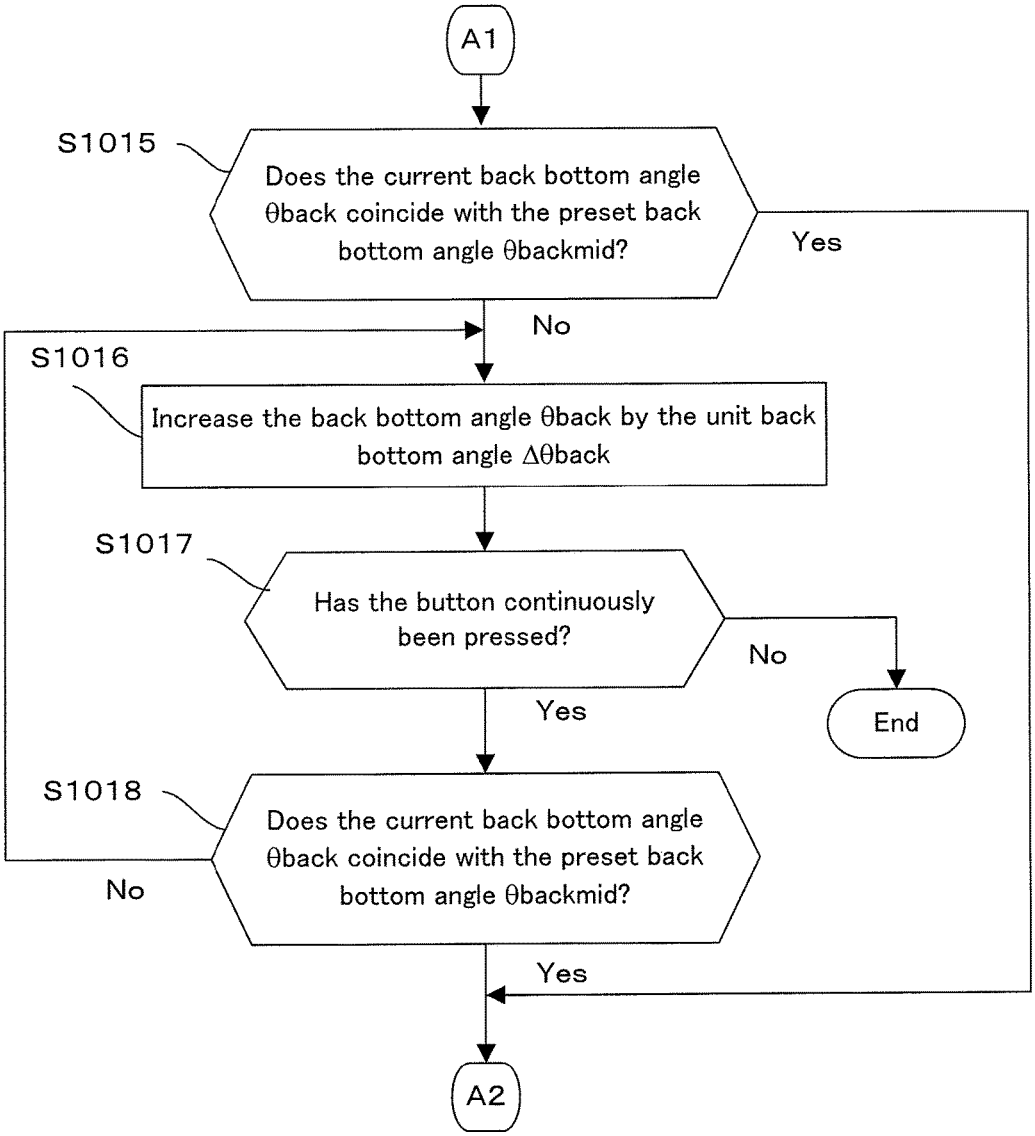
FIG. 12 A flow chart for illustrating a tilt and back-raising process performed by the drive controller 110 of the 4-drive control bed apparatus (example).
Figure 13:
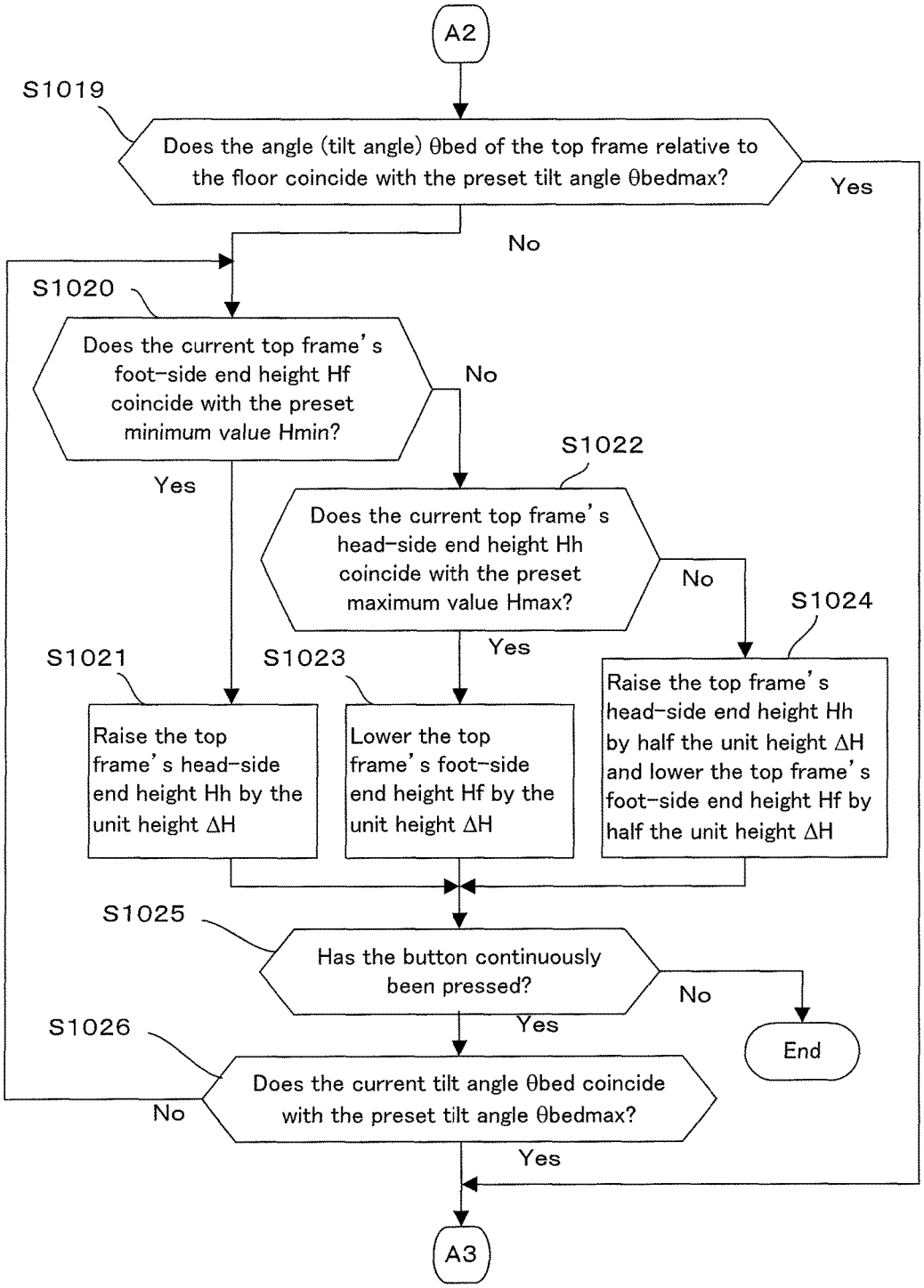
FIG. 13 A flow chart for illustrating a tilt and back-raising process performed by the drive controller 110 of the 4-drive control bed apparatus (example).
Figure 14:
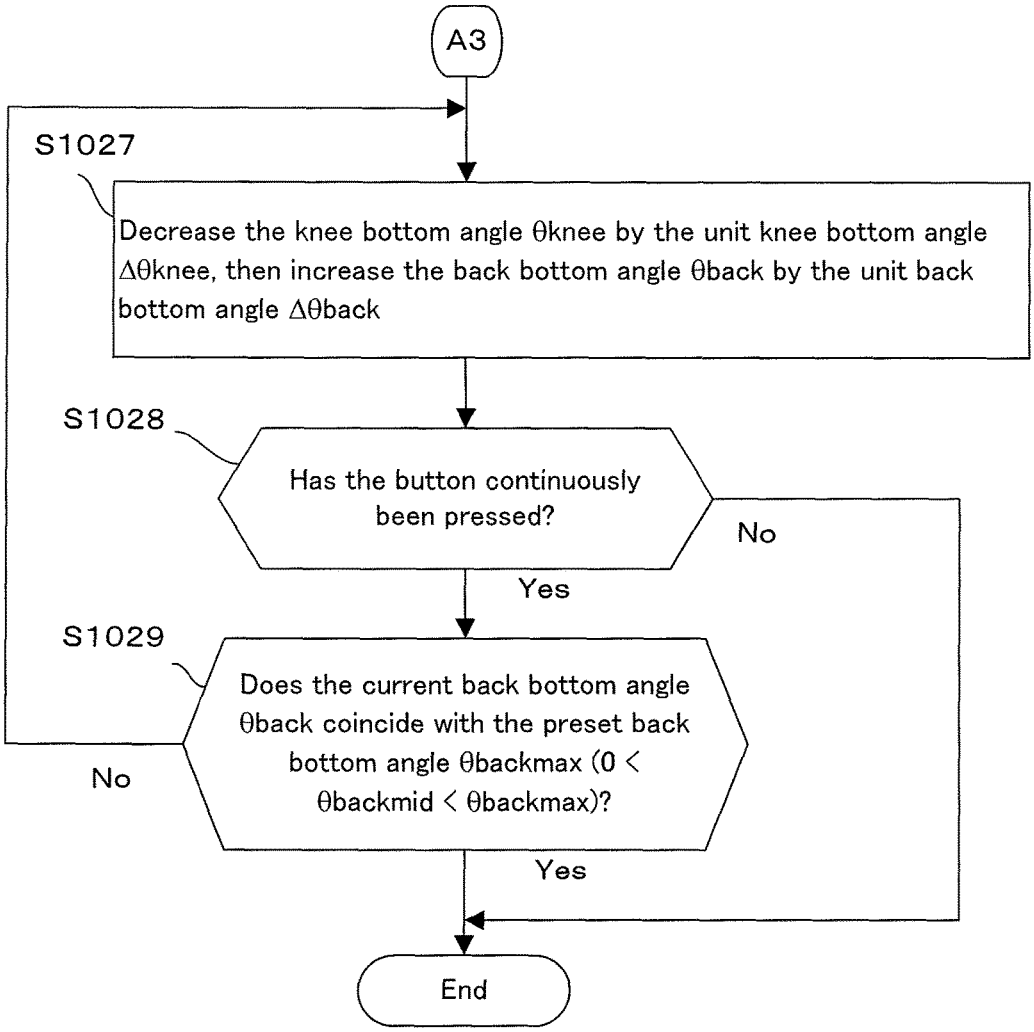
FIG. 14 A flow chart for illustrating a tilt and back-raising process performed by the drive controller 110 of the 4-drive control bed apparatus (example).

FIG. 10 is a flow chart for illustrating the operation of the state detector 120 and the angle calculator 130 in the 4-drive control bed apparatus. When any one of the buttons on the operation display portion 150 is pressed down (Step S1001—Yes), the following operation is started.

To begin with, the state detector 120 detects the height Hh of the head-side end EPh of the top frame 10 from the floor (Step S1002). For example, the head-side driver 230 (the actuator 32 of the head-side lift unit 14H) is equipped with an inner sensor for detecting the control value when the actuator 32 performs a stretching/contacting operation. The storage 140 stores a top frame head-side height conversion table for giving multiple correlations between the control value of the actuator 32 and the height Hh of the head-side end EPh of the top frame 10 from the floor. The state detector 120 converts the control value detected by the inner sensor of the actuator 32 into the height Hh of the head-side end EPh of the top frame 10 from the floor, referring to the top frame head-side height conversion table.

The state detector 120 also detects the height Hf of the foot-side end EPf of the top frame 10 from the floor (Step S1003). For example, the foot-side driver 230 (the actuator 34 of the foot-side lift unit 14F) is equipped with an inner sensor for detecting the control value when the actuator 34 performs a stretching/contacting operation. The storage 140 stores a top frame foot-side height conversion table for giving multiple correlations between the control value of the actuator 34 and the height Hf of the foot-side end EPf of the top frame 10 from the floor. The state detector 120 converts the control value detected by the inner sensor of the actuator 34 into the height Hf of the foot-side end EPf of the top frame 10 from the floor, referring to the top frame foot-side height conversion table.

Next, the angle calculator 130 calculates the angle (tilt angle) θb of the top frame 10 relative to the floor, based on the heights Hh and Hf detected by the state detector 120 (Step S1004). Specifically, the angle calculator 130 calculates the tilt angle θbed from the difference between the height Hh and the height Hf.

The state detector 120 also detects the angle θknee of the knee bottom 12*c* relative to the top frame 10 (Step S1005). For example, the knee bottom driver 220 (the actuator 38 for driving a knee-raising frame 22) is equipped with an inner sensor for detecting the control value when the actuator 38 performs a stretching/contacting operation. The storage 140 stores a knee bottom angle conversion table for giving multiple correlations between the control value of the actuator 38 and the angle θknee of the knee bottom 12*c* relative to the top frame 10. The state detector 120 converts the control value detected by the inner sensor of the actuator 38 into the angle θknee of the knee bottom 12*c* relative to the top frame 10, referring to the knee bottom angle conversion table.

The angle calculator 130 calculates the tilt angle θbed while the state detector 120 detects the angle θknee of the knee bottom 12*c*, whereby the angle of the knee bottom 12*c* relative to the floor is determined by θbed+θknee.

The state detector 120 also detects the angle θback of the back bottom 12*a* relative to the top frame 10 (Step S1006). For example, the back bottom driver 210 (the actuator 36 for driving the back-raising linkage 20) is equipped with an inner sensor for detecting the control value when the actuator 36 performs a stretching/contacting operation. The storage 140 stores a back bottom angle conversion table for giving multiple correlations between the control value of the actuator 36 and the angle θback of the back bottom 12*a* relative to the top frame 10. The state detector 120 converts the control value detected by the inner sensor of the actuator 36 into the angle θback of the back bottom 12*a* relative to the top frame 10, referring to the back bottom angle conversion table.

The angle calculator 130 calculates the tilt angle θbed while the state detector 120 detects the angle θback of the back bottom 12*a*, whereby the angle of the back bottom 12*a* with the floor is determined by θbed+θback.

Next, the operation of the drive controller 110 of the 4-drive control bed apparatus will be described.

The drive controller 110 will not perform the following process until one of buttons on the operation display portion 150 is pressed down by the user, so as to prevent the bed apparatus 1 from operating (in order to prevent malfunction) when the user is not having any intention to make control. Further, even though one of the buttons on the operation display portion 150 is pressed down by the user, in order to prevent malfunction, the drive controller 110 will not start the following process until the button has been pressed down for a predetermined period of time.

When the height adjustment raising command button 1507 on the operation display portion 150 has been pressed down for the predetermined period of time by the user, the height controller 112 of the drive controller 110 moves up the top frame 10 relative to the floor.

On the other hand, when the height adjustment lowering command button 1508 on the operation display portion 150 has been pressed down for the predetermined period of time by the user, the height controller 112 of the drive controller 110 moves down the top frame 10 relative to the floor.

When the knee position adjustment raising command button 1505 on the operation display portion 150 has been pressed down for the predetermined period of time by the user, the bottom controller 111 of the drive controller 110 performs the above-described knee-raising operation.

On the other hand, when the knee position adjustment lowering command button 1506 on the operation display portion 150 has been pressed down for the predetermined period of time by the user, the bottom controller 111 of the drive controller 110 performs the above-described knee-lowering operation.

When the back position adjustment raising command button 1503 on the operation display portion 150 has been pressed down for the predetermined period of time by the user, the bottom controller 111 of the drive controller 110 performs the above-described back-raising operation.

On the other hand, when the back position adjustment lowering command button 1504 on the operation display portion 150 has been pressed down for the predetermined period of time by the user, the bottom controller 111 of the drive controller 110 performs the above-described back-lowering operation.

When the tilt and back position adjustment raising command button 1501 on the operation display portion 150 has been pressed down for the predetermined period of time by the user, the bottom controller 111 and the height controller 112 of the drive controller 110 perform an aftermentioned tilt and back-raising process.

On the other hand, when the tilt and back position adjustment lowering command button 1502 on the operation display portion 150 has been pressed down for the predetermined period of time by the user, the bottom controller 111 and the height controller 112 of the drive controller 110 perform an aftermentioned tilt and back-lowering process.

FIGS. 11 to 14 are flow charts for illustrating the drive controller 110 of the 4-drive control bed apparatus to perform a tilt and back-raising process. The tilt and back-raising process is performed when the tilt and back position adjustment raising command button 1501 on the operation display portion 150 has been pressed down for the predetermined period of time by the user.

The bottom controller 111 of the drive controller 110 confirms whether or not the angle θknee of the knee bottom 12*c* relative to the top frame 10 coincides with the previously determined, preset knee bottom angle θkneemax (Step S1011).

As a result of confirmation of the angle θknee of the knee bottom 12*c*, the angle θknee coincides with the aforementioned preset knee bottom angle θkneemax (Step S1011—Yes). In this case, the drive controller 110 performs Step S1015 described below.

As a result of confirmation of the angle θknee of the knee bottom 12*c*, the angle θknee does not coincide with the aforementioned preset knee bottom angle θkneemax (Step S1011—No). In this case, the bottom controller 111 of the drive controller 110 controls the knee bottom driver 220 so that the angle θknee of the knee bottom 12*c* increases by a unit knee bottom angle Δθknee (Step S1012).

At this point, when the button (the tilt and back position adjustment raising command button 1501) has been continuously pressed down (Step S1013—Yes), the bottom controller 111 confirms whether or not the current angle θknee of the knee bottom 12*c* relative to the top frame 10 coincides with the aforementioned preset knee bottom angle θkneemax (Step S1014). On the other hand, the button has not been continuously pressed down (Step S1013—No), the drive controller 110 ends the tilt and back-raising process.

As a result of confirmation of the angle θknee of the knee bottom 12*c*, when the aforementioned angle θknee does not coincide with the preset knee bottom angle θkneemax (Step S1014—No), the drive controller 110 performs the above-described Step S1012.

As a result of confirmation of the angle θknee of the knee bottom 12*c*, the aforementioned angle θknee coincides with the preset knee bottom angle θkneemax (Step S1014—Yes). In this case, the bottom controller 111 confirms whether or not the current angle θback of the back bottom 12*a* relative to the top frame 10 is equal to a previously determined, preset back bottom angle θbackmid (0<θkneemax<θback mid) (Step S1015).

As a result of confirmation of the angle θback of the back bottom 12*a*, the angle θback coincides with the preset back bottom angle θbackmid (Step S1015—Yes). The drive controller 110 performs Step S1019 described below.

As a result of confirmation of the angle θback of the back bottom 12*a*, the angle θback does not coincide with the aforementioned preset back bottom angle θbackmid (Step S1015—No). In this case, the bottom controller 111 of the drive controller 110 controls the back bottom driver 210 so that the angle θback of the back bottom 12*a* increases by a unit back bottom angle Δθback (Step S1016).

At this point, the button (the tilt and back position adjustment raising command button 1501) has been continuously pressed down (Step S1017—Yes). The bottom controller 111 confirms whether or not the current angle θback of the back bottom 12*a* relative to the top frame 10 coincides with the aforementioned preset back bottom angle θbackmid (Step S1018). On the other hand, the button has not been continuously pressed down (Step S1017—No), the drive controller 110 ends the tilt and back-raising process.

As a result of confirmation of the angle θback of the back bottom 12*a*, when the aforementioned angle θback does not coincide with the preset back bottom angle θbackmid (Step S1018—No), the drive controller 110 performs the above-described Step S1016.

As a result of confirmation of the angle θback of the back bottom 12*a*, the aforementioned angle θback coincides with the preset back bottom angle θbackmid (Step S1018—Yes). In this case, the height controller 112 of the drive controller 110 confirms whether or not the current angle (tilt angle) θbed of the top frame 10 relative to the floor is equal to a previously determined, preset tilt angle θbedmax (0<θbedmax<θkneemax<θbackmid<θbackmax) (Step S1019).

As a result of confirmation of the tilt angle θbed of the top frame 10, when the tilt angle θbed coincides with the preset tilt angle θbedmax (Step S1019—Yes), the drive controller 110 performs an Step S1027 described below.

As a result of confirmation of the tilt angle θbed of the top frame 10, the tilt angle θbed does not coincide with the aforementioned preset tilt angle θbedmax (Step S1019—No). In this case, the height controller 112 confirms whether or not the current height Hf of the foot-side end EPf of the top frame 10 from the floor is the previously determined, preset minimum value Hmin (Step S1020).

As a result of confirmation of the height Hf of the foot-side end EPf of the top frame 10, the height Hf coincides with the aforementioned, preset minimum value Hmin (Step S1020—Yes). In this case, the height controller 112 controls the head-side driver 230 so that the height Hh of the end EPh of the top frame 10 moves up by a unit height ΔH (Step S1021).

As a result of confirmation of the height Hf of the foot-side end EPf of the top frame 10, the height Hf does not coincide with the aforementioned, preset minimum value Hmin (Step S1020—No). In this case, the height controller 112 confirms whether or not the current height Hh of the head-side end EPh of the top frame 10 from the floor coincides with the previously determined, preset maximum value Hmax (Step S1022).

As a result of confirmation of the height Hh of the head-side end EPh of the top frame 10, the height Hh coincides with the aforementioned, preset maximum value Hmax (Step S1022—Yes). In this case, the height controller 112 controls the foot-side driver 240 so that the height Hf of the foot-side end EPf of the top frame 10 moves down by the unit height ΔH (Step S1023).

As a result of confirmation of the height Hh of the head-side end EPh of the top frame 10, the height Hh does not coincide with the aforementioned, preset maximum value Hmax (Step S1022—No). In this case, the height controller 112 controls the foot-side driver 240 so that the height Hh of the head-side end EPh of the top frame 10 moves up by half the unit height ΔH and controls the foot-side driver 240 so that the height Hf of the foot-side end EPf of the top frame 10 moves down by half the unit height ΔH (Step S1024).

At this point, when the button (the tilt and back position adjustment raising command button 1501) has been continuously pressed down (Step S1025—Yes), the height controller 112 confirms whether or not the current angle (tilt angle) θbed of the bed frame 10 relative to the floor coincides with the aforementioned preset tilt angle θbedmax (Step S1026). On the other hand, when the button has not been continuously pressed down (Step S1025—No), the drive controller 110 ends the tilt and back-raising process.

As a result of confirmation of the tilt angle θbed of the top frame 10, the aforementioned tilt angle θbed does not coincide with the preset tilt angle θbedmax (Step S1026—No), the drive controller 110 performs the above-described Step S1020.

As a result of confirmation of the tilt angle θbed of the frame 10, the aforementioned tilt angle θbed coincides with the preset tilt angle θbedmax (Step S1026—Yes). In this case, the bottom controller 111 of the drive controller 110 controls the knee bottom driver 220 so as to decrease the angle θknee of the knee bottom 12*c* by the unit knee bottom angle Δθnee in order to reduce the user's feeling of being pressed on the chest and in the belly, and then controls the back bottom driver 210 so as to increase the angle θback of the back bottom 12*a* by the unit back bottom angle Δθback (Step S1027).

At this point, when the button (the tilt and back position adjustment raising command button 1501) has been continuously pressed down (Step S1028—Yes), the bottom controller 111 confirms whether or not the current angle θback of the back bottom 12*a* relative to the top frame 10 coincides with the aforementioned preset back bottom angle θbackmax (Step S1029).

As a result of confirmation of the angle θback of the back bottom 12*a*, the aforementioned angle θback does not coincide with the preset back bottom angle θbackmax (Step S1029—No). In this case, the drive controller 110 performs the above-described Step S1027.

As a result of confirmation of the angle θback of the back bottom 12*a*, the aforementioned angle θback coincides with the preset back bottom angle θbackmax (Step S1029—Yes). In this case, the drive controller 110 ends the tilt and back-raising process. The angle θknee of the knee bottom 12*c* at this stage, or the angle θknee of the knee bottom 12*c* after the knee-lowering operation (S1027 to S1029) preceded by the tilting operation (Steps S1019 to S1026), is set at the previously determined, preset knee bottom angle at tilting. The preset knee bottom angle at tilting is, for example equal to or greater than 0° relative to the ground, and smaller than the preset knee bottom angle θkneemax.

Figure 15:
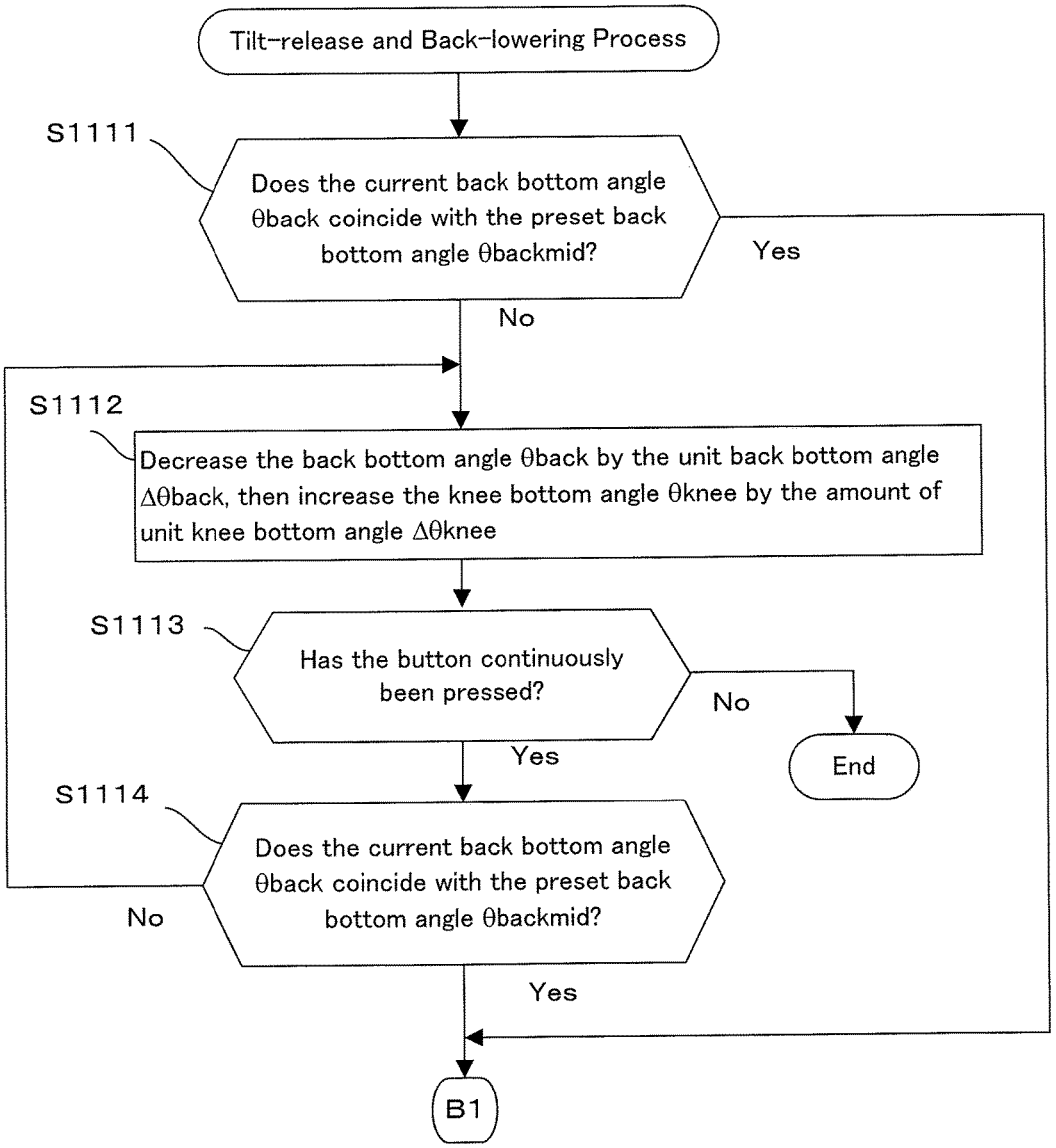
FIG. 15 A flow chart for illustrating a tilt-lease and back-lowering process performed by the drive controller 110 of the 4-drive control bed apparatus (example).
Figure 16:
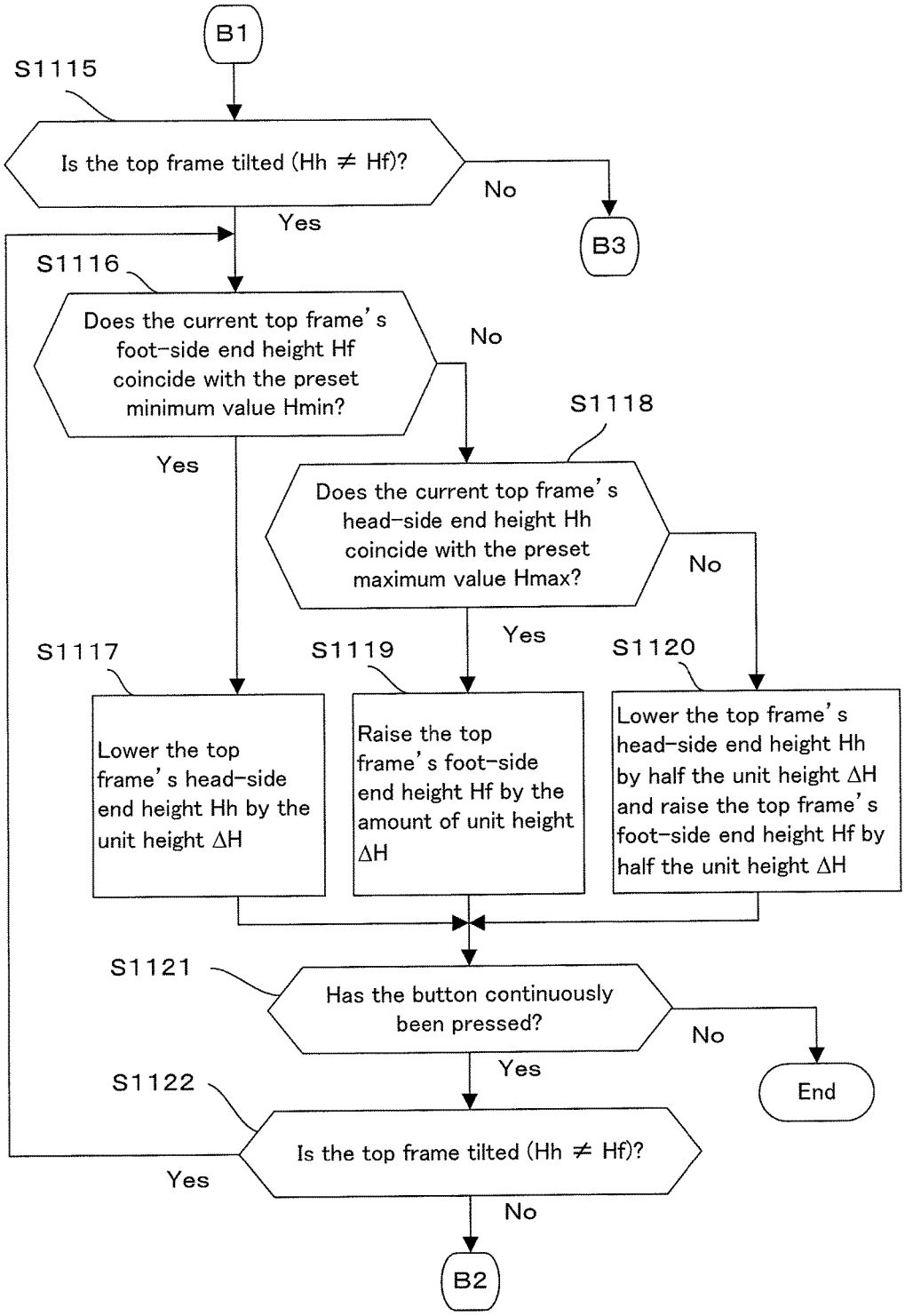
FIG. 16 A flow chart for illustrating a tilt-lease and back-lowering process performed by the drive controller 110 of the 4-drive control bed apparatus (example).
Figure 17:
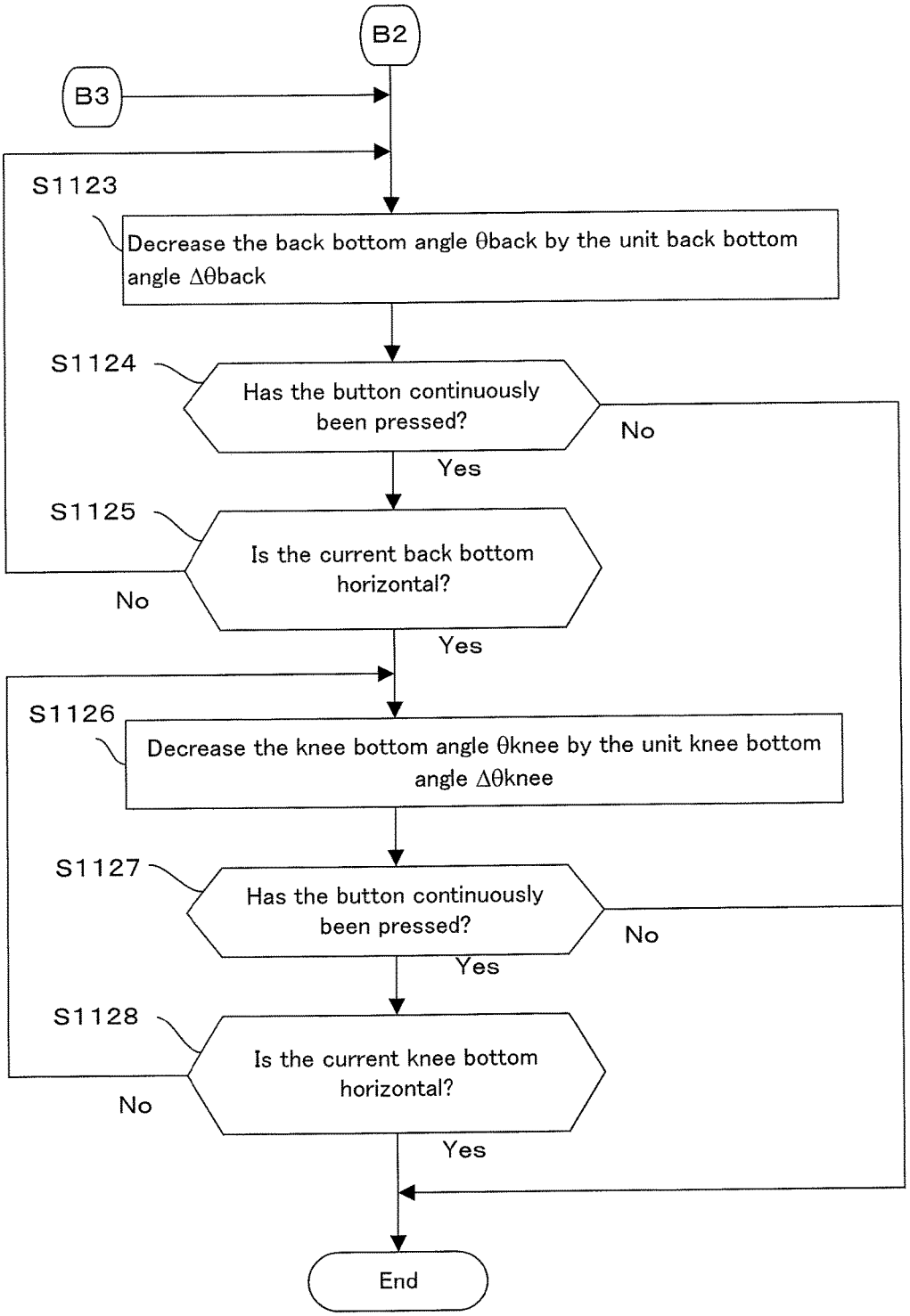
FIG. 17 A flow chart for illustrating a tilt-lease and back-lowering process performed by the drive controller 110 of the 4-drive control bed apparatus (example).

FIGS. 15 to 17 are flow charts for illustrating a tilt-release and back-lowering process performed by the drive controller 110 of the 4-drive control bed apparatus. The tilt-release and back-lowering process is performed when the tilt and back position adjustment lowering command button 1502 on the operation display portion 150 has been pressed down for a predetermined period of time by the user.

The bottom controller 111 of the drive controller 110 confirms whether or not the current angle θback of the back bottom 12*a* relative to the top frame 10 coincides with the aforementioned, preset back bottom angle θbackmid (Step S1111).

As a result of confirmation of the angle θback of the back bottom 12*a*, the angle θback coincides with the aforementioned preset back bottom angle θbackmid (Step S1111—Yes). In this case, the drive controller 110 performs Step S1115 described below.

As a result of confirmation of the angle θback of the back bottom 12*a*, the angle θback does not coincide with the preset back bottom angle θbackmid (Step S1111—No). In this case, in order to prevent the user in the tilted state from falling, the bottom controller 111 of the drive controller 110 controls the back bottom driver 210 so as to decrease the angle θback of the back bottom 12*a* by the unit back bottom angle Δθback, and then controls the knee bottom driver 220 so as to increase the angle θknee of the knee bottom 12*c* by the unit knee bottom angle Δθknee (Step S1112).

At this point, when the button (the tilt and back position adjustment lowering command button 1502) has been continuously pressed down (Step S1113—Yes), the bottom controller 111 confirms whether or not the current angle θback of the back bottom 12*a* relative to the top frame 10 coincides with the aforementioned preset back bottom angle θbackmid (Step S1114). On the other hand, the button has not been continuously pressed down (Step S1113—No), the drive controller 110 ends the tilt-release and back-lowering process.

As a result of confirmation of the angle θback of the back bottom 12*a*, when the angle θback does not coincide with the preset back bottom angle θbackmid (Step S1114—No), the drive controller 110 performs the above-described Step S1112.

As a result of confirmation of the angle θback of the back bottom 12*a*, the angle θback coincides with the aforementioned preset back bottom angle θbackmid (Step S1114—Yes). In this case, the height controller 112 of the drive controller 110 confirms whether or not the top frame 10 is tilted relative to the floor (Step S1115).

As a result of the tilt confirmation, the top frame 10 is not tilted. That is, the height Hh of the head-side end EPh of the top frame 10 from the floor is equal to the height Hf of the foot-side end EPf of the top frame 10 from the floor (Step S1115—No). In this case, the drive controller 110 performs Step S1123 described below.

As a result of the tilt confirmation, the top frame 10 is tilted. That is, the height Hh of the head-side end EPh of the top frame 10 from the floor is higher than the height Hf of the foot-side end EPf of the top frame 10 from the floor (Step S1115—Yes). In this case, the height controller 112 of the drive controller 110 confirms whether or not the height Hf of the foot-side end EPf of the top frame 10 from the floor coincides with the aforementioned, preset minimum value Hmin (Step S1116).

As a result of confirmation of the height Hf of the foot-side end EPf of the top frame 10, the height Hf coincides with the aforementioned, preset minimum value Hmin (Step S1116—Yes). In this case, the height controller 112 controls the head-side driver 230 so that the height Hh of the end EPh of the top frame 10 lowers by the unit height ΔH (Step S1117).

As a result of confirmation of the height Hf of the foot-side end EPf of the top frame 10, the height Hf does not coincide with the aforementioned, preset minimum value Hmin (Step S1116—No). In this case, the height controller 112 confirms whether or not the current height Hh of the head-side end EPh of the top frame 10 from the floor coincides with the previously determined, preset maximum value Hmax (Step S1118).

As a result of confirmation of the height Hh of the head-side end EPh of the top frame 10, the height Hf coincides with the aforementioned, preset maximum value Hmax (Step S1118—Yes). In this case, the height controller 112 controls the foot-side driver 240 so that the height Hf of the foot-side end EPf of the top frame 10 moves up by the unit height ΔH (Step S1119).

As a result of confirmation of the height Hh of the head-side end EPh of the top frame 10, the height Hh does not coincide with the aforementioned, preset maximum value Hmax (Step S1118—No). In this case, the height controller 112 controls the foot-side driver 240 so that the height Hh of the head-side end EPh of the top frame 10 moves up by half the unit height ΔH and controls the foot-side driver 240 so that the height Hf of the foot-side end EPf of the top frame 10 moves down by half the unit height ΔH (Step S1120).

At this point, when the button (the tilt and back position adjustment lowering command button 1502) has been continuously pressed down (Step S1121—Yes), the height controller 112 confirms whether or not the top frame 10 is currently tilted relative to the floor (Step S1122). On the other hand, when the button has not been continuously pressed down (Step S1121—No), the drive controller 110 ends the tilt-release and back-lowering process.

As a result of the tilt confirmation, the top frame 10 is tilted. That is, the height Hh of the head-side end EPh of the top frame 10 from the floor is higher than the height Hf of the foot-side end EPf of the top frame 10 from the floor (Step S1122—Yes). In this case, the drive controller 110 performs Step S1116 described above.

As a result of the tilt confirmation, the top frame 10 is not tilted. That is, the height Hh of the head-side end EPh of the top frame 10 from the floor is equal to the height Hf of the foot-side end EPf of the top frame 10 from the floor (Step S1122—No). In this case, the bottom controller 111 of the drive controller 110 controls the back bottom driver 210 so as to decrease the angle θback of the back bottom 12*a* by the unit back bottom angle Δθback (Step S1123).

At this point, when the button (the tilt and back position adjustment lowering command button 1502) has been continuously pressed down (Step S1124—Yes), the bottom controller 111 confirms whether or not the back bottom 12*a* is horizontal relative to the top frame 10 (Step S1125). On the other hand, when the button has not been continuously pressed down (Step S1124—No), the drive controller 110 ends the tilt-release and back-lowering process.

As a result of confirmation of the angle θback of the back bottom 12*a*, the back bottom 12*a* is not horizontal. That is, the angle θback of the back bottom 12*a* relative to the top frame 10 is equal to or greater than the unit back bottom angle Δθback (Step S1125—No). In this case, the drive controller 110 performs Step S1123 described above.

As a result of confirmation of the angle θback of the back bottom 12*a*, the angle θback is horizontal. That is, the angle θback of the back bottom 12*a* relative to the top frame 10 is 0° (Step S1125—Yes). In this case, the bottom controller 111 of the drive controller 110 controls the knee bottom driver 220 so as to decrease the angle θknee of the knee bottom 12*c* by the unit knee bottom angle Δθknee (Step S1126).

At this point, the button (the tilt and back position adjustment lowering command button 1502) has been continuously pressed down (Step S1127—Yes). The bottom controller 111 confirms whether or not the knee bottom 12*c* is currently horizontal relative to the top frame 10 (Step S1128). On the other hand, the button has not been continuously pressed down (Step S1127—No), the drive controller 110 ends the tilt-release and back-lowering process.

As a result of confirmation of the angle θknee of the knee bottom 12*c*, the angle θknee is not horizontal. That is, the angle θknee of the knee bottom 12*c* relative to the top frame 10 is equal to or greater than the unit knee bottom angle Δθknee (Step S1128—No). In this case, the drive controller 110 performs Step S1126 described above.

As a result of confirmation of the angle θknee of the knee bottom 12*c*, the angle θknee is horizontal. That is, the angle θknee of the knee bottom 12*c* relative to the top frame 10 is 0° (Step S1128—Yes). In this case, the drive controller 110 ends the tilt-release and back-lowering process.

As described heretofore, in the 4-drive control bed apparatus (example), when the tilt and back-raising process illustrated in FIGS. 11 to 14 is performed in accordance with a tilt and back-raising command, the bottom controller 111 controls the bottom drivers (back bottom driver 210 and knee bottom driver 220) as the knee-raising operation (S1011 to S1014) and the back-raising operation (S1015 to 1018) so that the angle θback of the back bottom 12*a* with the top frame 10 coincides with the previously determined, preset back bottom angle (in this case, the preset back bottom angle θbackmid) and that the angle θknee of the knee bottom 12*c* with the top frame 10 coincides with the previously determined, preset knee bottom angle θkneemax. Then, the height controller 112 controls the head-side driver 230 and the foot-side driver 240 as the tilting operation (S1019 to S1026) so that the angle θbed of the top frame 10 relative to the floor coincides with the previously determined, preset tilt angle θbedmax. In the back-raising operation, in the final position in which the user' back has been raised, since the user's knees are unbent, some users may feel uneasy. However, in the case where the tilting operation (S1019 to S1026) is performed after the knee-raising operation (S1011 to S1014) and the back-raising operation (S1015 to S1018) by the tilt and back-raising process, the knee bottom 12*c* serves as the seat of a chair while the back bottom 12*a* serves as the hip rest of the chair, so that the user will feel a sensation just like experiencing transition from the supine position in bed to the sitting position in a chair. Further, the preset back bottom angles θbackmax and θbackmid can be made smaller by the amount of the preset tilt angle θbedmax, compared to the case where the tilting operation (S1019 to S1026) is not performed. In this way, according to the 4-drive control bed apparatus 1, since the tilting operation (S1019 to S1026) is performed after execution of the knee-raising operation (S1011 to S1014) and the back-raising operation (S1015 to S1018), the user can take a comfortable position just like sitting in the final position after the user's back has been raised. Further, it is also possible to reduce user's feeling of being pressed on the back and in the belly and prevent user's significant body slippage.

Further, according to the 4-drive control bed apparatus 1, because the knee-raising operation is performed together with the back-raising operation before start of the tilting operation in the tilt and back-raising process illustrated in FIGS. 11 to 14, it is possible to prevent the user in the tilted state from falling.

Further, in the 4-drive control bed apparatus, after the tilt and back-raising process, when the tilt-release and back-lowering process illustrated in FIGS. 15 to 17 is performed in accordance with a tilt-release and back-lowering command, the bottom controller 111 controls the bottom drivers (back bottom driver 210 and knee bottom driver 220) as the back-lowering operation (S1111 to S1114) and the knee-raising operation (S1112) so that the angle θback of the back bottom 12*a* with the top frame 10 coincides with the previously determined, preset back bottom angle (in this case, the preset back bottom angle θbackmid) and that the angle θknee of the knee bottom 12*c* with the top frame 10 coincides with the previously determined, preset knee bottom angle θkneemax. Then, the height controller 112 controls the head-side driver 230 and the foot-side driver 240 as the tilt-releasing operation (S1115 to S1122) so that the angle θbed of the top frame 10 relative to the floor becomes equal to 0. When the tilt-releasing operation (S1115 to S1122) is performed after execution of the back-lowering operation (S1111 to S1114) and the knee-raising operation (S1112) by the tilt-release and back-lowering process, the user feels a sensation just like experiencing transition from the sitting position in a chair to the supine position with knees raised in bed. In the above way, according to the bed apparatus 1 of the present invention, the tilt-releasing operation (S1115 to S1122) is performed after execution of the back-lowering operation (S1111 to S1114) and the knee-raising operation (S1112), then the back-lowering operation (S1123 to S1125) and the knee-lowering operation (S1126 to S1128) are performed, whereby it is possible to transition the user's position from sitting on a chair to lying in bed.

Further, in the present invention, when the tilting operation (S3, S1019 to S1026) and the tilt-releasing operation (S13, S1115 to S1122) are effected, the drive controller 110 may be adapted to give a warning sound.

Though the embodied modes of the present invention have been detailed with reference to the drawings, the specific configuration should not be limited to the embodiments. Designs and others that do not depart from the gist of this invention should also be included in the scope of claims.

INDUSTRIAL APPLICABILITY

The bed apparatus of the present invention can be applied to various kinds of bed apparatus such as in-home care nursing bed apparatus, facility care nursing bed apparatus, hospital bed apparatus and the like.

DESCRIPTION OF REFERENCE NUMERALS

1 . . . bed apparatus
10 . . . top frame
12*a* . . . back bottom
12*b* . . . hip bottom
12*c* . . . knee bottom
12*d* . . . foot bottom
14H . . . head-side lift unit
14F . . . foot-side lift unit
16H . . . support frame
16F . . . support frame
18 . . . joint frame
20 . . . back-raising linkage
22 . . . knee-raising linkage
32 . . . actuator
34 . . . actuator
36 . . . actuator
38 . . . actuator
100 . . . controller
110 . . . drive controller
111 . . . bottom controller
112 . . . height controller
120 . . . state detector
130 . . . angle calculator
140 . . . storage
150 . . . operation display portion
210 . . . back bottom driver
220 . . . knee bottom driver
230 . . . head-side driver
240 . . . foot-side driver
1501 . . . tilt and back position adjustment raising command button
1502 . . . tilt and back position adjustment lowering command button
1503 . . . back position adjustment raising command button
1504 . . . back position adjustment lowering command button
1505 . . . knee position adjustment raising command button
1506 . . . knee position adjustment lowering command button
1507 . . . height adjustment raising command button
1508 . . . height adjustment lowering command button

The invention claimed is:

1. A bed apparatus comprising:

a top frame having a head-side and a foot-side;

a back bottom segment placed on the top frame;

a knee bottom segment placed on the top frame;

a bottom driver configured to actuate at least one of the back bottom and the knee bottom segment to raise a back or knees of a user;

a head-side driver and foot-side driver that are operatively coupled to the top frame and are configured to move up and down the head side and the foot side of the top frame relative to a floor, respectively;

a height controller that is configured to control the head-side driver and/or the foot-side driver in response to a tilt and back-raising command so as to tilt the top frame, when a predetermined top frame condition is met, such that the head-side height of the top frame is higher than the foot-side height of the top frame;

a bottom controller that is configured to control the bottom driver in response to the tilt and back-raising command so as to actuate both the knee bottom segment and the back bottom segment, when a predetermined knee bottom segment condition and a predetermined back bottom segment condition are met, to raise both the back and the knees of the user prior to the height controller controlling the head-side driver and/or the foot-side driver to tilt the top frame in response to the tilt and back-raising command; and a single command button configured to provide the tilt and back-raising command.

2. The bed apparatus according to claim 1, wherein the bottom controller is configured to control the bottom driver in response to the tilt and back-raising command so as to raise the back bottom segment that is placed on the top frame to raise a back of the user prior to the height controller controlling the head-side driver and/or the foot-side driver to tilt the top frame in response to the tilt and back-raising command, whereby the back of the user and the knees of the user would be raised prior to the top frame being tilted by the head-side driver and/or the foot-side driver in response to the tilt and back-raising command.

3. The bed apparatus according to claim 2, wherein the bottom driver comprises:

a knee bottom driver configured to actuate the knee bottom segment; and a back bottom driver configured to actuate the back bottom segment.

4. The bed apparatus according to claim 1, wherein the bottom controller is configured to control the bottom driver so as to raise the back bottom segment that is placed on the top frame to raise a back of the user in response to the tilt and back-raising command and wherein the height controller is configured to control the head-side driver and/or the foot-side driver in response to the tilt and back-raising command so as to tilt the top frame prior to the bottom controller controlling the bottom driver to raise the back bottom segment in response to the tilt and back-raising command.

5. The bed apparatus according to claim 1, wherein the bottom controller is configured to:

control the bottom driver in response to the tilt and back-raising command so as to raise the back bottom segment that is placed on to the top frame to raise a back of the user prior to the height controller controlling the head-side driver and/or the foot-side driver to tilt the top frame in response to the tilt and back-raising command, whereby the back of the user and the knees of the user would be raised prior to the top frame being tilted by the head-side driver and/or the foot-side driver in response to the tilt and back-raising command; and control the bottom driver so as to again raise the back bottom segment to further raise the back of the user in response to the tilt and back-raising command, wherein the height controller is configured to control the head-side driver and/or the foot-side driver in response to the tilt and back-raising command so as to tilt the top frame prior to the bottom controller controlling the bottom driver to again raise the back bottom segment in response to the tilt and back-raising command.

6. The bed apparatus according to claim 5, wherein the bottom driver comprises:

a knee bottom driver configured to actuate the knee bottom segment; and a back bottom driver configured to actuate the back bottom segment.

7. The bed apparatus according to claim 1, wherein the bottom controller is configured to control the bottom driver in response to the tilt and back-raising command so as to actuate the knee bottom segment to lower the knees of the user;

wherein the height controller is configured to control the head-side driver and/or the foot-side driver in response to the tilt and back-raising command so as to tilt the top frame prior to the bottom controller controlling the bottom driver to lower knee bottom segment in response to the tilt and back-raising command; and wherein an angle of the knee bottom segment formed relative to the ground by actuating the knee bottom segment to lower in response to the tilt and back-raising command after the top frame is tilted is equal to or greater than 0°.

8. The bed apparatus according to claim 1, wherein the bottom controller is configured to control the bottom driver so as to again actuate the knee bottom segment to further raise the knees of the user in response to the tilt and back-raising command; and wherein the height controller is configured to control the head-side driver and/or the foot-side driver in response to the tilt and back-raising command so as to tilt the top frame prior to the bottom controller controlling the bottom driver to again raise the knee bottom segment in response to the tilt and back-raising command.

9. A bed apparatus control method comprising:

a height control step of performing a tilting operation, in response to a tilt and back-raising command, so as to tilt a top frame such that a height of a head-side of the top frame is higher than a height of a foot-side of the top frame by moving up and down, respectively, the head side and/or the foot side of the top frame relative to the floor;

a bottom control step of performing a knee-raising operation and a back-rising operation, in response to the tilt and back-raising command, so as to actuate both a back bottom segment and a knee bottom segment, that is placed on the top frame, to raise both the back and knees of the user prior to the tilting of the top frame in response to the tilt and back-raising command; and providing the tilt and back-raising command in response to a single actuation of a button.

* * * * *